US010821372B2

(12) United States Patent
Bertrand et al.

(10) Patent No.: US 10,821,372 B2
(45) Date of Patent: Nov. 3, 2020

(54) BUILDING BLOCKS FOR A TOY BUILDING SET

(71) Applicant: 9321-7032 QUEBEC INC, Laval (CA)

(72) Inventors: Yves Bertrand, Laval (CA); Jan Popik, Laval (CA)

(73) Assignee: 9321-7032 QUEBEC INC., Laval (CA)

( * ) Notice: Subject to any disclaimer, the term of this patent is extended or adjusted under 35 U.S.C. 154(b) by 0 days.

(21) Appl. No.: 16/058,509

(22) Filed: Aug. 8, 2018

(65) Prior Publication Data

US 2020/0047078 A1 Feb. 13, 2020

(51) Int. Cl.
*A63H 33/08* (2006.01)
*A63H 33/04* (2006.01)

(52) U.S. Cl.
CPC ..... *A63H 33/086* (2013.01); *A63H 33/044* (2013.01)

(58) Field of Classification Search
CPC ..... A63H 33/086; A63H 33/044
USPC ..... 446/124, 125, 128
See application file for complete search history.

(56) References Cited

U.S. PATENT DOCUMENTS 2,019,653 A * 11/1935 Buyer ..... E04B 2/16 52/592.5
2,262,199 A * 11/1941 Paulson ..... A63H 33/088 446/110
4,823,532 A * 4/1989 Westerburgen ..... A63H 33/08 446/122
D332,643 S * 1/1993 Knudsen ..... D21/484
5,729,943 A * 3/1998 Cambiuzzi ..... E04B 2/46 52/438
D553,199 S * 10/2007 Glickman ..... D21/484
D641,055 S * 7/2011 Andersen ..... D21/484
8,715,030 B2 * 5/2014 Chin ..... A63H 33/086 273/276

* cited by examiner

*Primary Examiner* — Vishu K Mendiratta
(74) *Attorney, Agent, or Firm* — Blue Filament Law PLLC

(57) ABSTRACT

The present disclosure relates to building blocks for a toy building set. More particularly, the present disclosure relates to a building block configured to releasably join another building block of a similar construction. The building block comprises a hollow main body which defines a lower surface, an upper surface and walls joining the lower and the upper surfaces. At least one of the walls comprises a first wall section and a second wall section parallel to and distant from the first wall section. The building block further comprises spaced apart projections that extend from the upper surface and spaced apart recess sections disposed within the hollow main body. When two building blocks are releasably connected together, a longitudinal groove is provided between the second wall section of the lower building block and the hollow main body of the upper building block when the blocks are fully connected one to another.

20 Claims, 44 Drawing Sheets

BUILDING BLOCKS FOR A TOY BUILDING SET

TECHNICAL FIELD

The present disclosure relates to building blocks for a toy building set.

BACKGROUND

There already exists on the market a plurality of building blocks and of toy building sets for allowing construction of a toy building or the construction of a toy structure. Such building blocks are known to be made of a rigid plastic and further provided with a number of cylindrical projections that fit with sufficient tightness into the hollow of another building block or into the hollows of two or more adjacent building blocks, thus permitting the construction of toy buildings/structures in three dimensions.

Yet, while the above-described building blocks are successfully used and enjoyed, they provide limitations in the construction of some specific toy buildings/structures.

There is therefore a need for building blocks that are configured to provide a useful alternative to known building blocks and toy building sets.

SUMMARY

It is an object of the present disclosure to provide building blocks for a toy building set that overcome or mitigate one or more disadvantages of known building blocks or at least provide a useful alternative.

According to an embodiment, there is provided a building block for a toy building set, the building block being releasably joinable to another building block, the building block comprising:

a hollow main body defining:

a lower surface for supporting the hollow main body;

an upper surface opposite the lower surface;

walls joining the lower surface and the upper surface, at least one of the walls comprising:

a first wall section defining a first wall surface;

a second wall section defining a second wall surface parallel to and distant from the first wall surface;

spaced apart projections extending from the upper surface in a direction opposite the lower surface; and spaced apart recess sections disposed within the hollow main body about the lower surface, each one of the spaced apart recess sections being in a substantial alignment with a corresponding one of the spaced apart projections;

wherein when at least one of the spaced apart projections is releasably connected to at least one of the spaced apart recess sections of the other building block, a longitudinal groove is provided between the second wall section and the hollow main body of the other building block when the building block is fully connected to the other building block.

According to another embodiment, there is provided the building block as defined above, wherein the first wall section defines a first surface area and the second wall section defines a second surface area, the second surface area being greater than the first surface area.

According to a further embodiment, there is provided the building block as defined above, wherein the first wall section defines a first wall section upper longitudinal edge and the second wall section defines a second wall section upper longitudinal edge, and further wherein the longitudinal groove is formed between the second wall section upper longitudinal edge, at least part of the first wall surface and the lower surface of the hollow main body of the other building block when the building block is fully connected to the other building block.

According to yet another embodiment, there is provided the building block as defined above, wherein the upper surface defines an upper surface first longitudinal edge and an upper surface second longitudinal edge distant from the upper surface first longitudinal edge.

According to another embodiment, there is provided the building block as defined above, wherein the first wall section upper longitudinal edge corresponds to one of the upper surface first and second longitudinal edges.

According to a further embodiment, there is provided the building block as defined above, wherein the second wall section upper longitudinal edge is parallel to and distant from the upper surface first and second longitudinal edges.

According to yet another embodiment, there is provided the building block as defined above, wherein the lower surface defines a lower surface first longitudinal edge and a lower surface second longitudinal edge distant from the lower surface first longitudinal edge; and further wherein the first wall section defines a first wall section lower edge and the second wall section defines a second wall section lower longitudinal edge, both the first wall section lower edge and the second wall section lower longitudinal edges corresponding to one of the lower surface first and second longitudinal edges.

According to another embodiment, there is provided the building block as defined above, wherein the first wall section further defines: a first wall section first side edge; and a first wall section second side edge opposite the first wall section first side edge; and further wherein the second wall section further defines: a second wall section first side edge; and a second wall section second side edge opposite the second wall section first side edge.

According to a further embodiment, there is provided the building block as defined above, wherein the first wall section first side edge is at a distance from the second wall section first side edge.

According to yet another embodiment, there is provided the building block as defined above, wherein the first wall section second side edge is at a distance from the second wall section second side edge.

According to another embodiment, there is provided the building block as defined above, wherein the hollow main body further defines spaced apart receiving grooves inbetween at least some of the spaced apart projections and about the upper surface.

According to a further embodiment, there is provided the building block as defined above, wherein each one of the spaced apart projections comprises: a projection upper surface; and projection walls joining the projection upper surface and the upper surface of the hollow main body.

According to yet another embodiment, there is provided the building block as defined above, wherein the hollow main body defines wall inner surfaces, the building block further comprising: an inner wall within the hollow main body, extending from the lower surface towards the upper surface and joining together two of the walls, the inner wall together with some of the walls forming the spaced apart recess sections.

According to another embodiment, there is provided the building block as defined above, wherein the hollow main body defines wall inner surfaces, the building block further comprising: spaced apart inner walls within the hollow main body, each one of the spaced apart inner walls extending from the lower surface towards the upper surface and joining together two of the walls, the spaced apart inner walls together with some of the walls forming the spaced apart recess sections.

According to a further embodiment, there is provided the building block as defined above, further comprising: inner longitudinal protrusions extending from the lower surface towards the upper surface outwardly from each one of the wall inner surfaces and further outwardly from each one of the spaced apart inner walls, wherein each one of the inner longitudinal protrusions is adapted to interface with a corresponding one of the projection walls when the building block is fully connected to the other building block.

According to yet another embodiment, there is provided the building block as defined above, wherein the hollow main body defines a cross-sectional surface area, the cross-section surface area defining at least one of: a rectangular shape, a squared shape, an incurved shape, an L-like shape, a T-like shape, an incurved L-like shape, an incurved T-like shape, a ring shape and a rounded shape.

According to another embodiment, there is provided the building block as defined above, wherein each one of the spaced apart projections comprises: a projection upper surface defining a substantially squared surface; and four projection walls joining the projection upper surface and the upper surface of the hollow main body.

According to a further embodiment, there is provided the building block as defined above, wherein one of the four projection walls extend from the upper surface respectively at the upper surface first and second longitudinal edges.

According to yet another embodiment, there is provided the building block as defined above, wherein two of the four projection walls extend from the upper surface respectively at the upper surface first and second longitudinal edges.

According to another embodiment, there is provided the building block as defined above, wherein at least one of: each one of the spaced apart receiving grooves and the longitudinal groove is configured to releasably connect with at least one of: a toy flooring component, a toy window component, a toy bridge component and a toy roofing component.

BRIEF DESCRIPTION OF THE DRAWINGS

Further features and advantages of the present disclosure will become apparent from the following detailed description, taken in combination with the appended drawings, in which.

DETAILED DESCRIPTION

Figure 1:
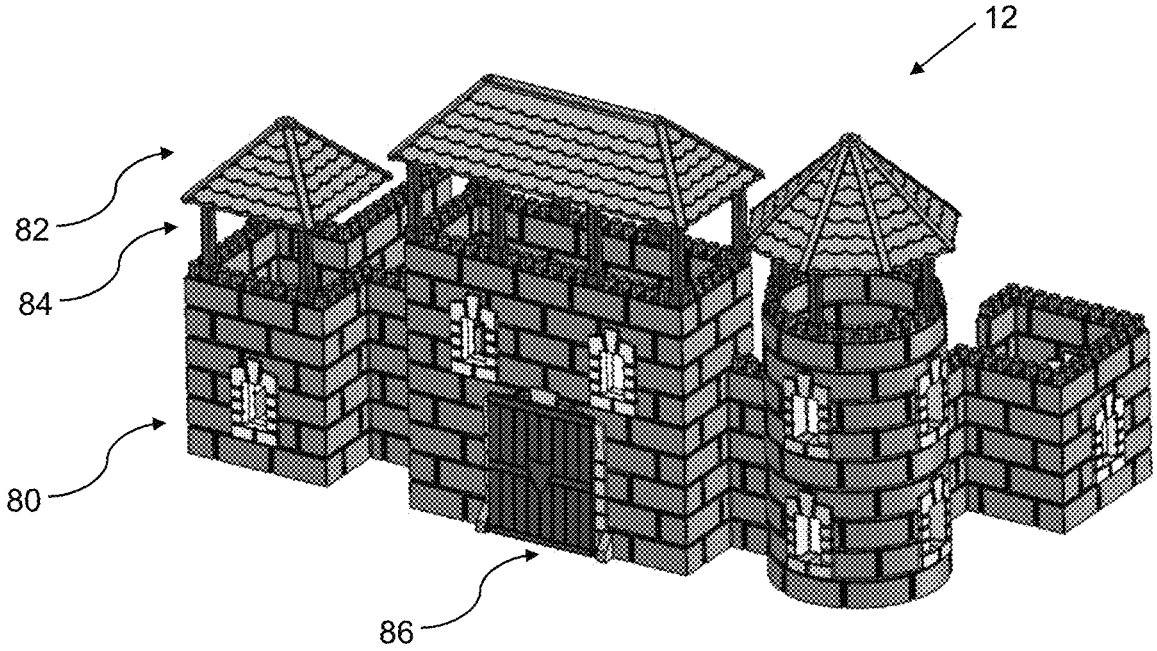
FIG. 1 is a top perspective view of a toy building, or structure, in accordance with an embodiment.

Referring now to the drawings and more particularly to FIG. 1, there is shown a toy building or a toy structure 12. Toy building 12 is made of a plurality of connected together building blocks and building block components, such as, window building blocks 80, roof building blocks 82, post building blocks 84, door building blocks 86 and the like.

Figure 2A:
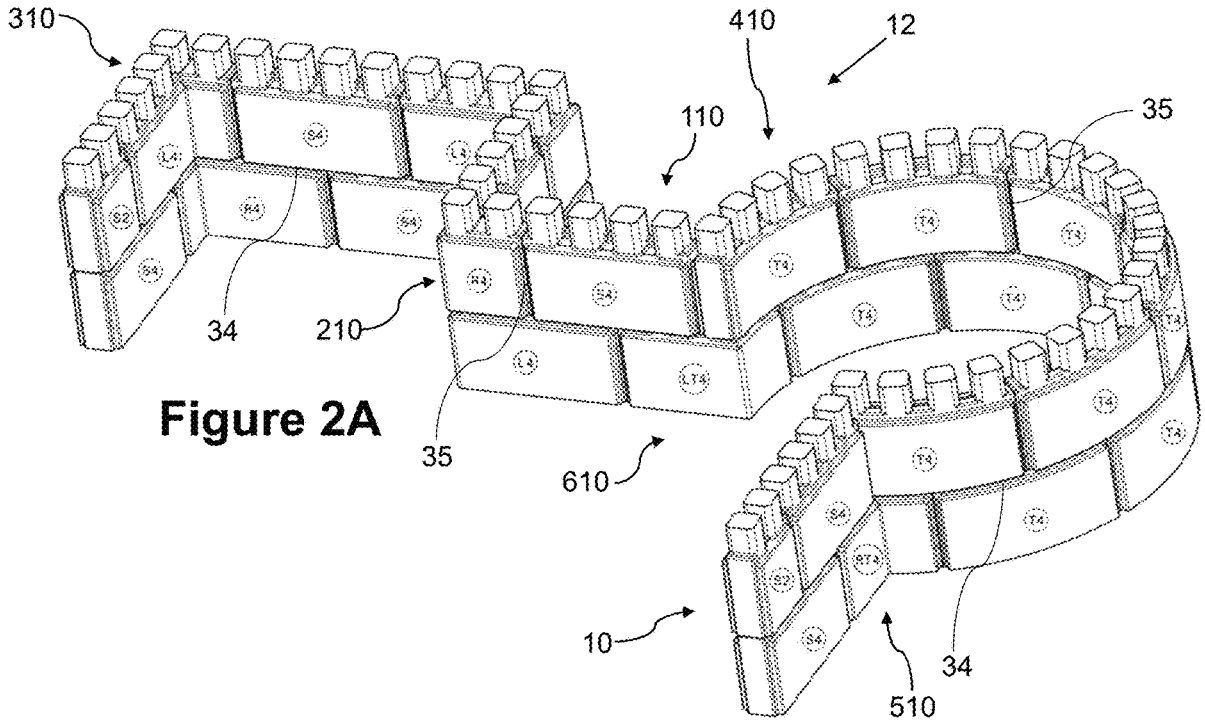
FIG. 2A is top perspective view of some building blocks being connected one to another in accordance with another embodiment.
Figure 2B:
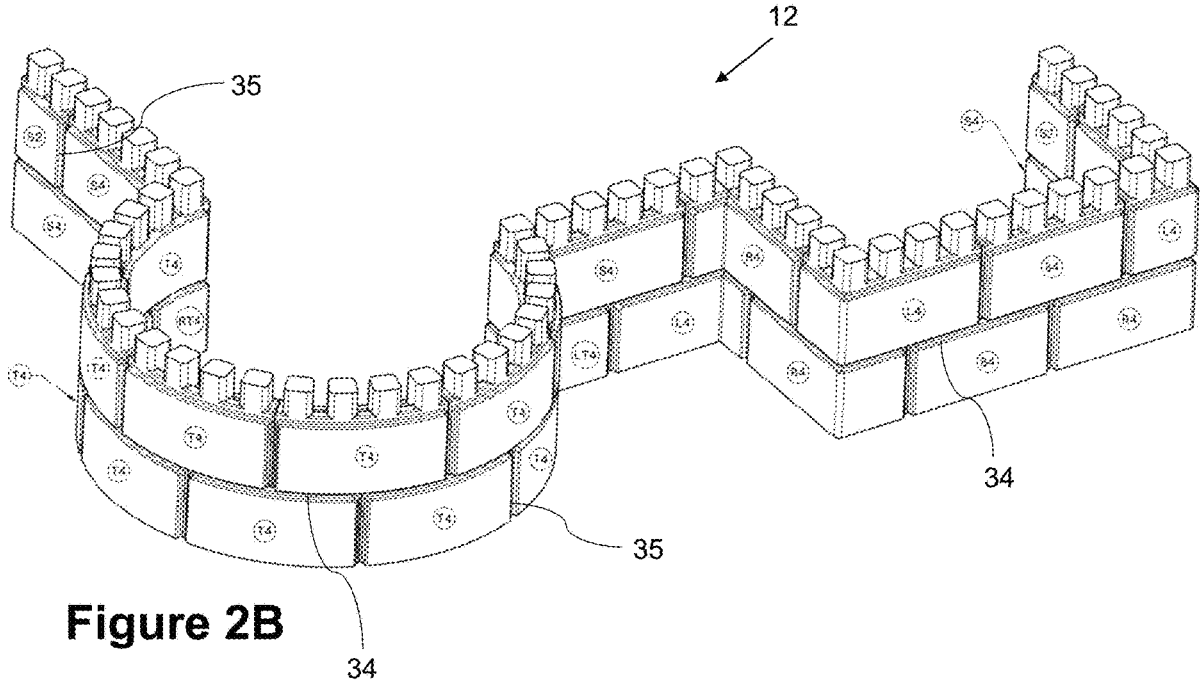
FIG. 2B is another top perspective view of the building blocks shown in FIG. 2A.
Figure 2C:
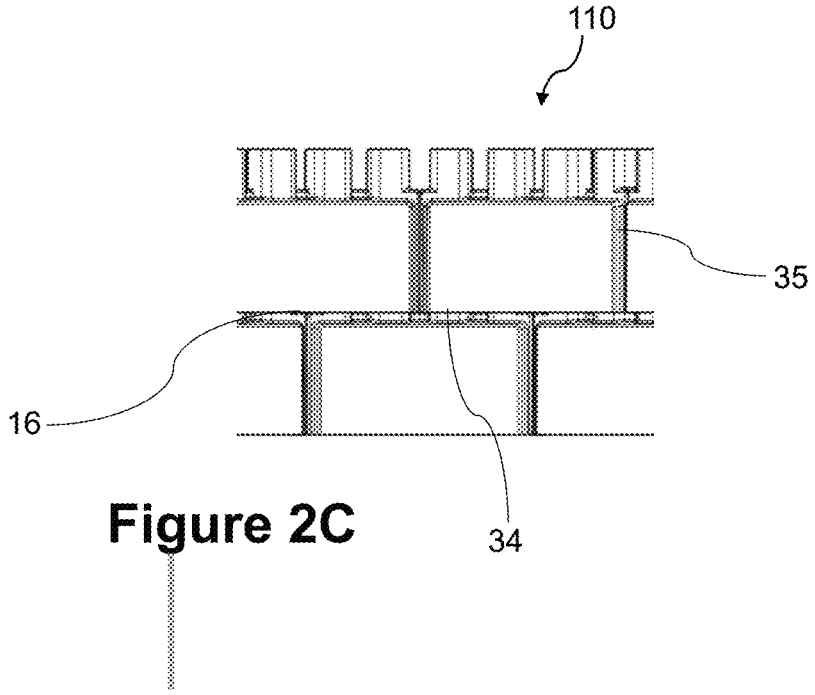
FIG. 2C is a front elevation view of some of the building blocks shown in FIG. 2A.

Referring now more particularly to FIGS. 2A to 2C, there are shown a plurality of building blocks, namely building blocks 10, 110, 210, 310, 410, 510, 610, that are releasably connected one to another such as to provide part of a toy building 12, or toy structure. As it will be described in more details below, and as best shown in FIG. 2C, configuration of each one of the building blocks 10, 110, 210, 310, 410, 510, 610 provides a useful alternative to known building blocks as horizontally oriented longitudinal grooves 34 and vertically oriented longitudinal grooves 35 are provided inbeetween the plurality of fully connected building blocks, here building blocks 110. Such horizontally and vertically oriented longitudinal grooves 34, 35 therefore provide the toy building 12 with a special appearance, as bricks look to be connected one adjacent another.

Referring now more particularly to FIGS. 3A to 3I, there is shown a two-head building block 10, or building block 10.

Figure 3A:
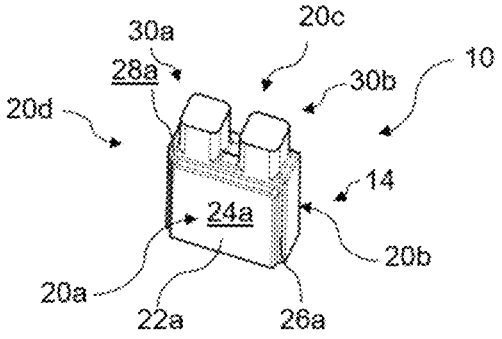
FIG. 3A is a top perspective view of a two-head building block in accordance with a further embodiment.
Figure 3B:
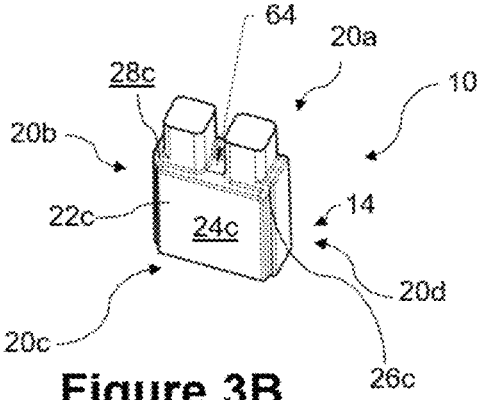
FIG. 3B is another top perspective view of the two-head building block shown in FIG. 3A.
Figure 3C:
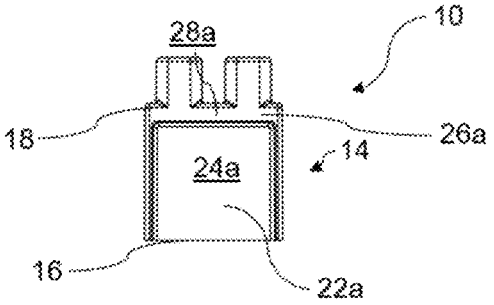
FIG. 3C is a front elevation view of the two-head building block shown in FIG. 3A.
Figure 3D:
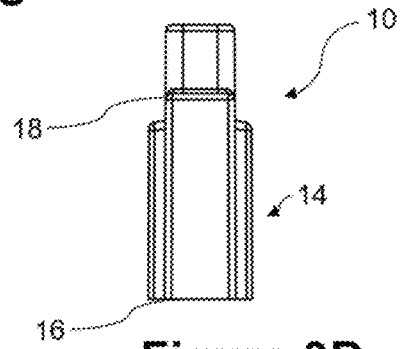
FIG. 3D is a side elevation view of the two-head building block shown in FIG. 3A.

Building block 10 comprises a substantially rectangular hollow main body 14 defining a lower surface 16, which is adapted to support hollow main body 14, and an upper surface 18, opposite lower surface 16. Building block 10 further comprises four walls 20*a*, 20*b*, 20*c*, 20*d* that together join lower surface 16 and upper surface 18. As best shown in FIGS. 3A and 3B, some of the walls 20*a*, 20*b*, 20*c*, 20*d*, namely walls 20*a*, 20*c*, each comprises a first wall section 22*a*, 22*c* which defines a first wall surface 24*a*, 24*c*, as well as a second wall section 26*a*, 26*c*, which defines a second wall surface 28*a*, 28*c*. Second wall surfaces 28*a*, 28*c* are parallel to and distant from first wall surfaces 24*a*, 24*c* (second wall surface 28*a* is parallel to and distant from first wall surface 24*a*, while second wall surface 28*c* is parallel to and distant from first wall surface 24*c*).

Still referring to FIGS. 3A to 3I, there is shown that building block 10 further comprises spaced apart projections or heads 30*a*, 30*b*, that extend from upper surface 18 in a direction opposite lower surface 16. Building block 10 further comprises spaced apart recess sections 32*a*, 32*b* (FIG. 3I) disposed within hollow main body 14 about lower surface 16. Each one of the spaced apart recess sections 32*a*, 32*b* is being in a substantial alignment with a corresponding one of the spaced apart projections 30*a*, 30*b*.

According to the configuration of building block 10, when at least one of the spaced apart projections 30*a*, 30*b* of a lower building block 10 is releasably connected to at least one of the spaced apart recess sections 32*a*, 32*b* of an upper building block 10 (or to any other similar building block 10, 110, 210, 310, 410, 510, 610), an horizontally oriented longitudinal groove 34 is provided/created between second wall section 26*a*, 26*c* of lower building block 10 and hollow main body 14 of upper building block 10 when lower building block 10 is fully connected to upper building block 10 (FIGS. 1A, 1B, 1D, 4A and 4B).

Still referring to FIGS. 3A to 3I, there is shown that first wall sections 22*a*, 22*c* each defines a first surface area and second wall sections 26*a*, 26*c* each defines a second surface area, and that the second surface areas are being greater than the first surface areas. Each one of the first wall sections 22*a*, 22*c* further defines a first wall section upper longitudinal edge 42*a*, 42*c* and each one of the second wall sections 26*a*, 26*c* defines a second wall section upper longitudinal edge 40*a*, 40*c*. Therefore, horizontally oriented longitudinal groove 34 is formed between second first wall section upper longitudinal edges 42*a*, 42*c* (of lower building block 10), at least part of first wall surfaces 24*a*, 24*c* (of lower building block 10) and lower surface 16 of hollow main body 14 of upper building block 10, again, when building blocks 10 are fully connected one to another.

Figure 3E:
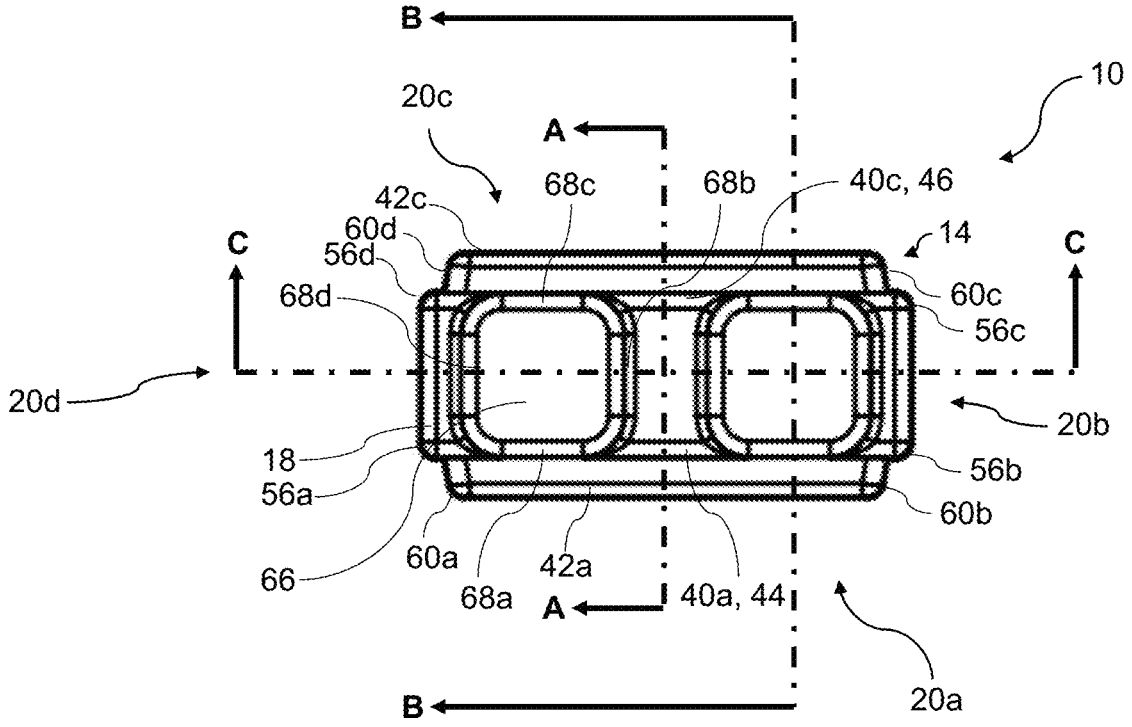
FIG. 3E is a top plan view of the two-head building block shown in FIG. 3A.
Figure 3F:
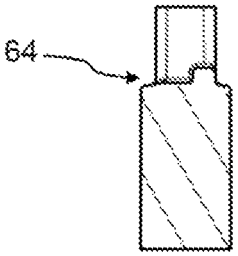
FIG. 3F is a cross-sectional view of the two-head building block shown in FIG. 3E, taken along line A-A.
Figure 3G:
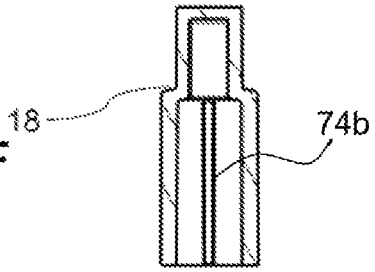
FIG. 3G is a cross-sectional view of the two-head building block shown in FIG. 3E, taken along line B-B.
Figure 3H:
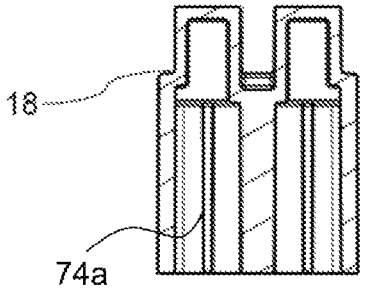
FIG. 3H is a cross-sectional view of the two-head building block shown in FIG. 3E, taken along line C-C.

Still referring to FIGS. 3A to 3I, there is shown that upper surface 18 defines an upper surface first longitudinal edge 44 and an upper surface second longitudinal edge 46, which is distant from upper surface first longitudinal edge 44. As best shown in FIG. 3E, second wall section upper longitudinal edges 40*a*, 40*c* respectively correspond to upper surface first and second longitudinal edges 44, 46. Moreover, there is shown that first wall section upper longitudinal edges 42*a*, 42*c* are parallel to and distant from upper surface first and second longitudinal edges 44, 46 respectively.

Still referring to FIGS. 3A to 3J, there is shown that lower surface 16 defines a lower surface first longitudinal edge 48 and a lower surface second longitudinal edge 50, which is distant from lower surface first longitudinal edge 48. Additionally, each one of the first wall sections 22*a*, 22*c* defines a first wall section lower edge 52*a*, 52*c* and each one of second wall sections 26*a*, 26*c* defines a second wall section lower longitudinal edge 54*a*, 54*c*. Both first wall section lower edges 52*a*, 52*c* and second wall section lower longitudinal edges 54*a*, 54*c* correspond to respectively lower surface first and second longitudinal edges 48, 50.

Each one of the first wall sections 22*a*, 22*c* further defines a first wall section side edge 56*a*, 56*b*, 56*c*, 56*d*. Similarly, each one of the second wall sections 26*a*, 26*c* further defines a second wall section side edge 60*a*, 60*b*, 60*c*, 60*d*. Therefore, according to the two-head building block 10 shown in FIGS. 3A to 3I, first wall section side edge 56*a* is at a distance from second wall section side edge 60*a* and similarly, first wall section side edge 56*b* is at a distance from second wall section side edge 60*b*. Additionally, first wall section side edge 56*c* is at a distance from second wall section side edge 60*c* and similarly, first wall section side edge 56*d* is at a distance from second wall section side edge 60*d* of wall 20*c* (FIG. 3E). Therefore, vertically oriented longitudinal groove 35 is formed between second wall section side edges of two adjacent building blocks, as shown in FIG. 2C, and at least part of first wall surfaces 24*a*, 24*c* (of such adjacent blocks), again, when building blocks 10 are fully connected one adjacent another.

Referring now more particularly to FIG. 3B, there is shown that hollow main body 14 further defines a receiving groove 64 inbetween spaced apart projections 30*a*, 30*b* and about upper surface 18. Such receiving groove 64 is configured to releasably connect with, or receive, a plurality of additional building components, such as, without limitations, toy flooring components, toy window components, toy bridge components, toy roofing components and the like.

Referring now more particularly to FIG. 3E, there is shown that each one of the spaced apart projections 30*a*, 30*b* comprises a projection upper surface 66, defining a substantially squared surface, and projection walls 68*a*, 68*b*, 68*c*, 68*d*, joining projection upper surface 66 and upper surface 18 of hollow main body 14. The substantially squared surface may prevent a building block to rotate when releasably connected to another building block, even if connected by only one projection 30*a* or 30*b*. For each one of the spaced apart projections, or heads, 30*a*, 30*b*, two of the four projection walls, namely projection walls 68*a*, 68*c*, extend from upper surface 18 respectively at the upper surface first and second longitudinal edges 44, 48. Therefore, as shown, projection wall 68*a* share the same plan with first wall surface 24*a* of wall 20*a*, while projection wall 68*c* share the same plan with first wall surface 24*c* of wall 20*c*.

Figure 3I:
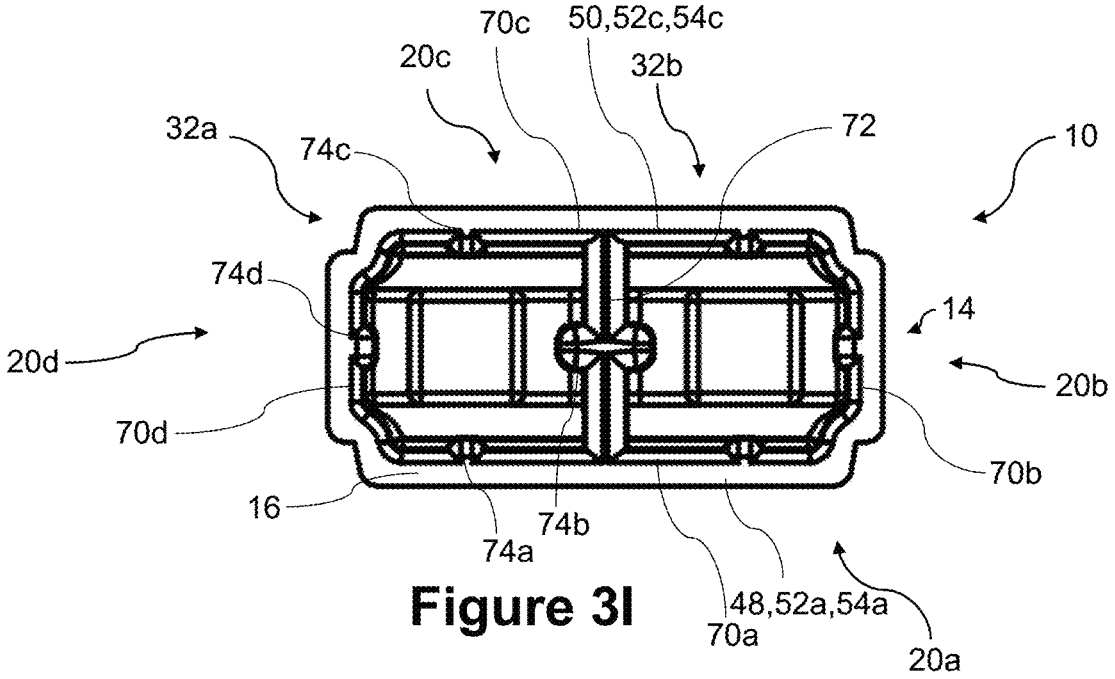
FIG. 3I is a bottom plan view of the two-head building block shown in FIG. 3A.

Referring now more particularly to FIG. 3I, there is shown that hollow main body 14 defines wall inner surfaces 70*a*, 70*b*, 70*c*, 70*d*. Building block 10 also further comprises an inner wall 72, within hollow main body 14. Inner wall 72 extends from lower surface 16 towards upper surface 18 and joins together walls 20*a*, 20*c*. Inner wall 72, together with walls 20*a*, 20*b*, 20*c*, 20*d*, forms the spaced apart recess sections 32*a*, 32*b*.

Building block 10, as defined above, further comprises inner longitudinal protrusions (four inner longitudinal protrusions 74*a*, 74*b*, 74*c*, 74*d* for each one of the recess sections 32*a*, 32*b*). Each one of the inner longitudinal protrusions 74*a*, 74*b*, 74*c*, 74*d* longitudinally extends from lower surface 16 towards upper surface 18. Only some of the inner longitudinal protrusions, namely protrusions 74*a*, 74*c*, extend outwardly from wall inner surfaces 70*a*, 70*c*, while the remaining ones extend outwardly from inner wall 72. Each one of the inner longitudinal protrusions 74*a*, 74*b*, 74*c*, 74*d* is adapted to interface with a corresponding one of projection walls 68*a*, 68*b*, 68*c*, 68*d* when a lower building block 10 (or any other building 10, 110, 210, 310, 410, 510, 610 and the like) is fully connected to an upper building block 10 (or any other building 110, 210, 310, 410, 510, 610 and the like).

Figure 4A:
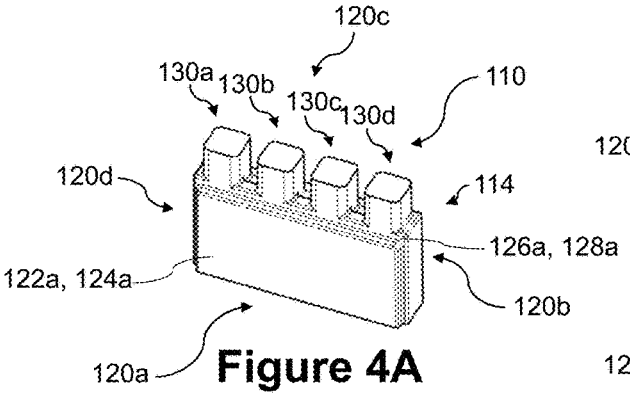
FIG. 4A is a top perspective view of a four-head building block in accordance with yet another embodiment.
Figure 4B:
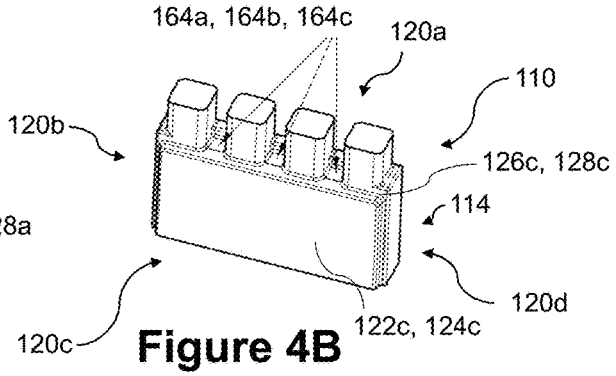
FIG. 4B is another top perspective view of the four-head building block shown in FIG. 4A.
Figure 4C:
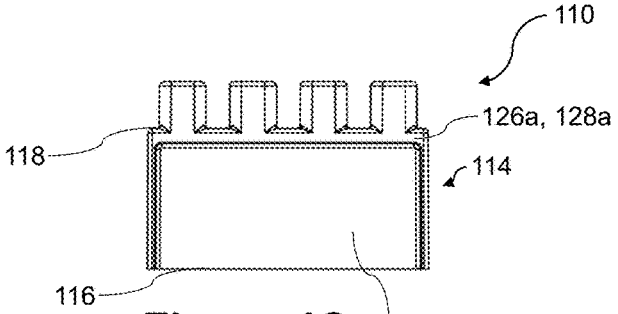
FIG. 4C is a front elevation view of the four-head building block shown in FIG. 4A.
Figure 4D:
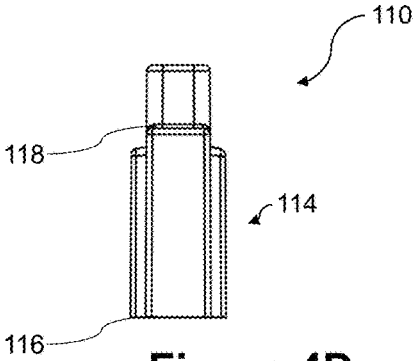
FIG. 4D is a side elevation view of the four-head building block shown in FIG. 4A.

Referring now more particularly to FIGS. 4A to 4I, there is shown a four-head building block 110, or building block 110, which is similar to building block 10. Indeed, building block 110 comprises a substantially rectangular hollow main body 114 defining a lower surface 116, which is adapted to support hollow main body 114, and an upper surface 118, opposite lower surface 116. Building block 110 further comprises four walls 120*a*, 120*b*, 120*c*, 120*d* that together join lower surface 116 and upper surface 118. As best shown in FIGS. 4A and 4B, some of the walls 120*a*, 120*b*, 120*c*, 120*d*, namely walls 120*a*, 120*c*, each comprises a first wall section 122*a*, 122*c* which defines a first wall surface 124*a*, 124*c*, as well as a second wall section 126*a*, 126*c*, which defines a second wall surface 128*a*, 128*c*. Second wall surfaces 128*a*, 128*c* are parallel to and distant from first wall surfaces 124*a*, 124*c* (second wall surface 128*a* is parallel to and distant from first wall surfaces 124*a*, while second wall surface 128*c* is parallel to and distant from first wall surfaces 124*c*).

Still referring to FIGS. 4A to 4I, there is shown that building block 110 further comprises spaced apart projections or heads 130*a*, 130*b*, 130*c*, 130*d* that extend from upper surface 118 in a direction opposite lower surface 116. Building block 110 further comprises spaced apart recess sections 132*a*, 132*b*, 132*c*, 132*d* disposed within hollow main body 114 about lower surface 116. Each one of the spaced apart recess sections 132*a*, 132*b*, 132*b*, 132*c* is being in a substantial alignment with a corresponding one of the spaced apart projections 130*a*, 130*b*, 130*c*, 130*d*.

According to the configuration of building block 110, and referring also to FIGS. 5A to 5D, when at least one of the spaced apart projections 130*a*, 130*b*, 130*c*, 130*d* of a lower building block 110 is releasably connected to at least one of the spaced apart recess sections 132*a*, 132*b*, 132*c*, 132*d* of an upper building block 110 (or to any other similar building block 10, 110, 210, 310, 410, 510, 610), an horizontally oriented longitudinal groove 34 is provided/created between second wall section 126*a*, 126*c* of lower building block 110 and hollow main body 114 of upper building block 110 when lower building block 110 is fully connected to upper building block 110.

Still referring to FIGS. 4A to 4I, there is shown that first wall sections 122*a*, 122*c* each defines a first surface area and second wall sections 126*a*, 126*c* each defines a second surface area, and that the second surface areas are being greater than the first surface areas. Each one of the first wall sections 122*a*, 122*c* further defines a first wall section upper longitudinal edge 142*a*, 142*c* and each one of the second wall sections 126*a*, 126*c* defines a second wall section upper longitudinal edge 140*a*, 140*c*. Therefore, horizontally oriented longitudinal groove 34 is formed between first wall section upper longitudinal edges 142*a*, 142*c* (of lower building block 110), at least part of first wall surfaces 124*a*, 124*c* (of lower building block 110) and lower surface 116 of hollow main body 114 of upper building block 110, again, when building blocks 110 are fully connected one to another (FIGS. 5A to 5D).

Figure 4E:
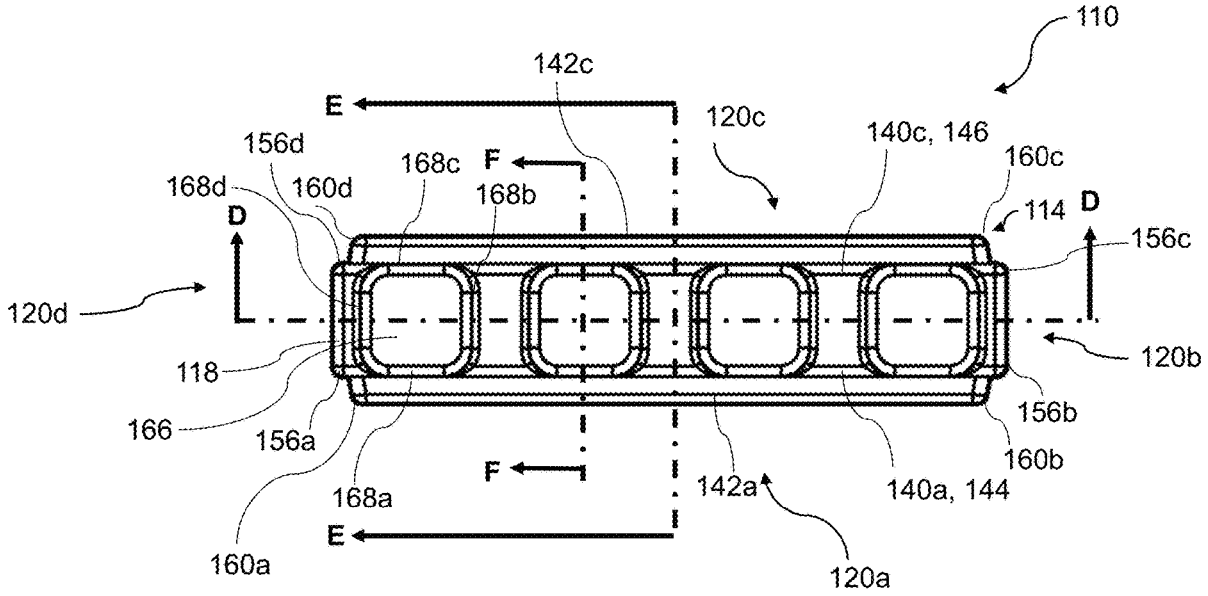
FIG. 4E is a top plan view of the four-head building block shown in FIG. 4A.
Figure 4F:
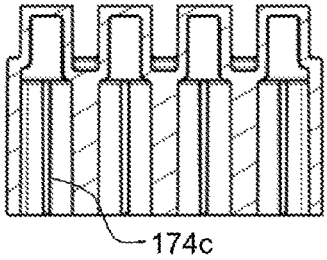
FIG. 4F is a cross-sectional view of the four-head building block shown in FIG. 4E, taken along line D-D.
Figure 4H:
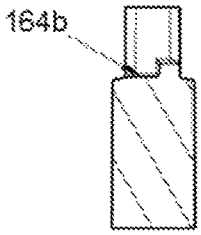
FIG. 4H is a cross-sectional view of the four-head building block shown in FIG. 4E, taken along line F-F.
Figure 4G:
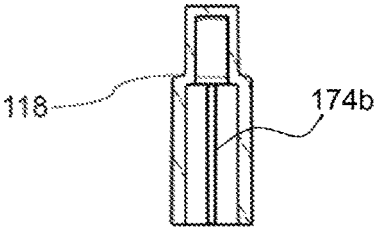
FIG. 4G is a cross-sectional view of the four-head building block shown in FIG. 4E, taken along line E-E.
Figure 4I:
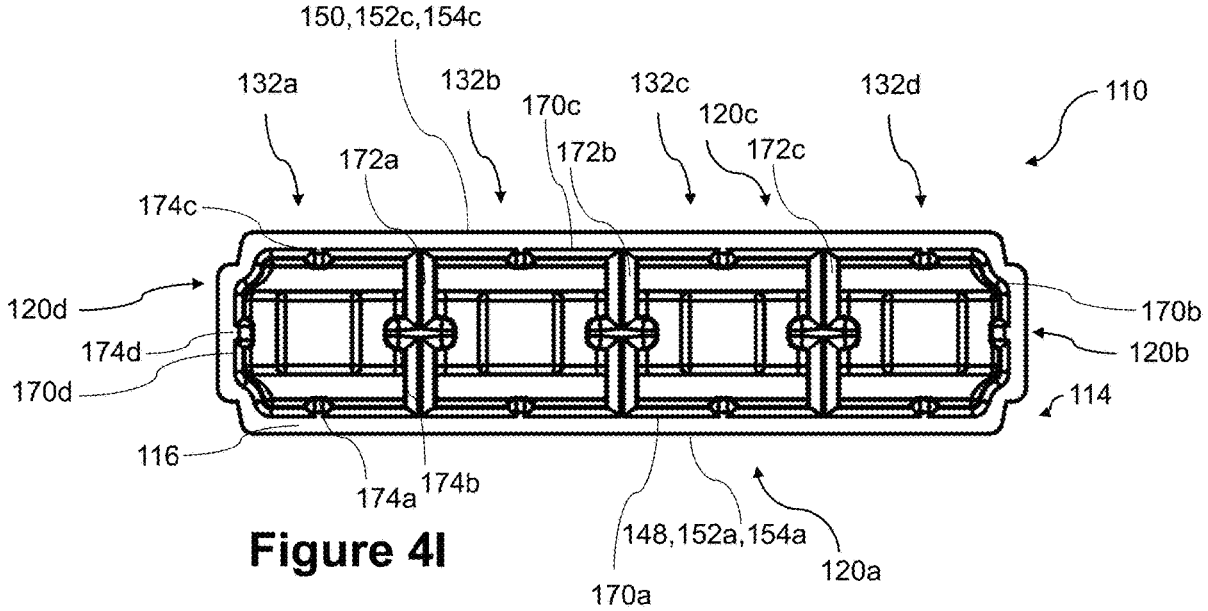
FIG. 4I is a bottom plan view of the four-head building block shown in FIG. 4A.

Still referring to FIGS. 4A to 4I, there is shown that upper surface 118 defines an upper surface first longitudinal edge 144 and an upper surface second longitudinal edge 146, which is distant from upper surface first longitudinal edge 144. As best shown in FIG. 4E, first second wall section upper longitudinal edges 140*a*, 140*c* respectively correspond to upper surface first and second longitudinal edges 144, 146. Moreover, there is shown that first wall section upper longitudinal edges 142*a*, 142*c* are parallel to and distant from upper surface first and second longitudinal edges 144, 146 respectively.

Still referring to FIGS. 4A to 4I, there is shown that lower surface 116 defines a lower surface first longitudinal edge 148 and a lower surface second longitudinal edge 150, which is distant from lower surface first longitudinal edge 148. Additionally, each one of the first wall sections 122*a*, 122*c* defines a first wall section lower edge 152*a*, 152*c* and each one of second wall sections 126*a*, 126*c* defines a second wall section lower longitudinal edge 154*a*, 154*c*. Both first wall section lower edges 152*a*, 152*c* and second wall section lower longitudinal edges 154*a*, 154*c* correspond to respectively lower surface first and second longitudinal edges 148, 150.

Figure 5A:
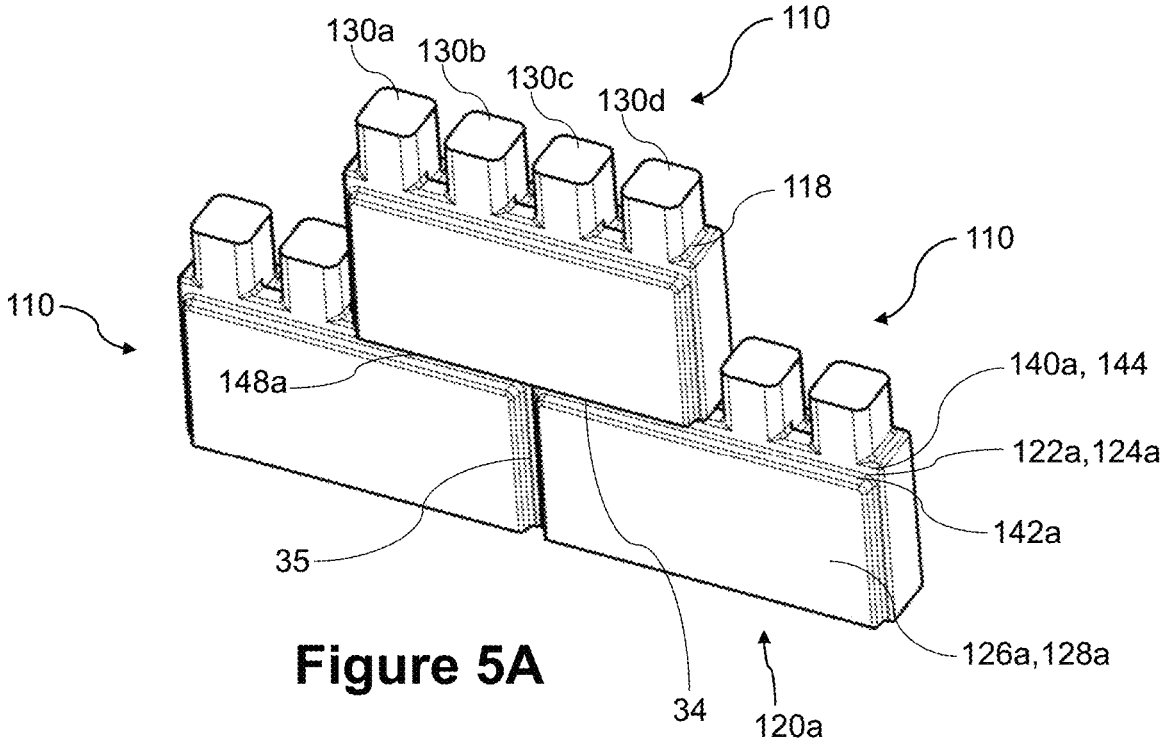
FIG. 5A is a top perspective view of three four-head building blocks, as shown in FIGS. 4A-4I, connected together.
Figure 5B:
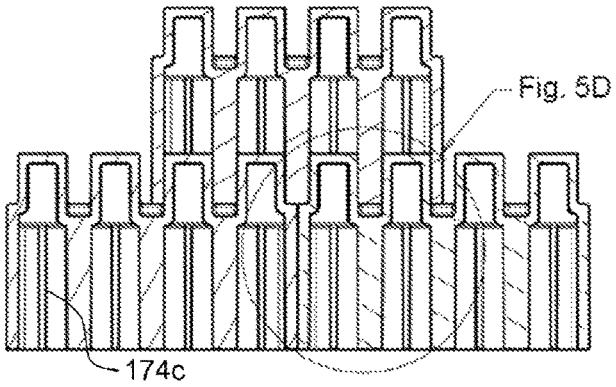
FIG. 5B is cross-sectional front elevation view of the three connected four-head building blocks shown in FIG. 5A.
Figure 5C:
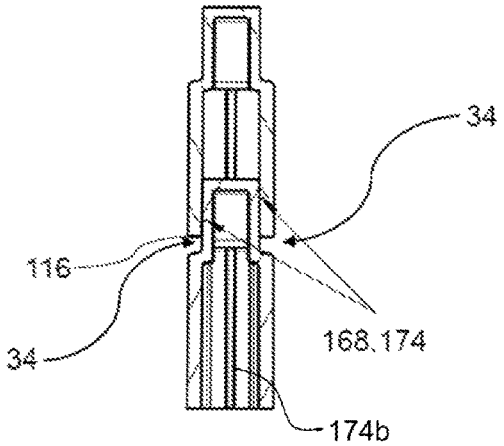
FIG. 5C is a side elevation side elevation view of the three connected four-head building blocks shown in FIG. 5A.
Figure 5D:
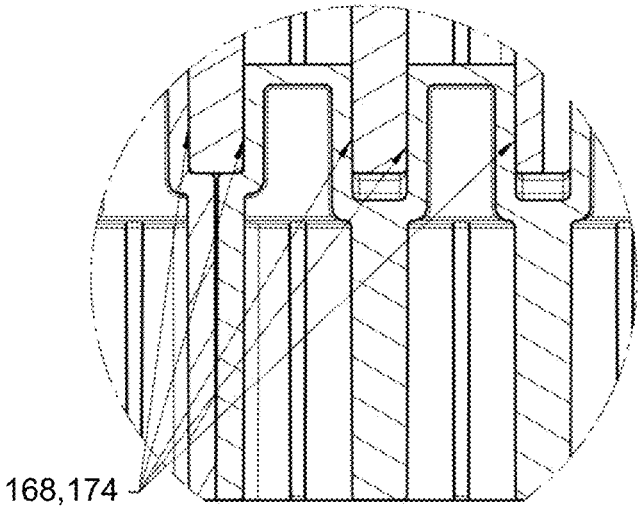
FIG. 5D is a closed-up view of the connected building blocks shown in FIG. 5B.

Each one of the first wall sections 122*a*, 122*c* further defines a first wall section side edge 156*a*, 156*b*, 156*c*, 156*d*. Similarly, each one of the second wall sections 126*a*, 126*c* further defines a second wall section side edge 160*a*, 160*b*, 160*c*, 160*d*. Therefore, according to the four-head building block 110 shown in FIGS. 4A to 4I, first wall section side edge 156*a* is at a distance from second wall section side edge 160*a* and similarly, first wall section side edge 156*b* is at a distance from second wall section side edge 160*b* (wall 120*a*). Additionally, first wall section side edge 156*c* is at a distance from second wall section side edge 160*c* and similarly, first wall section side edge 156*d* is at a distance from second wall section side edge 160*d* of wall 120*c* (FIG. 4E). Therefore, as best shown in FIG. 5A, vertically oriented longitudinal groove 35 is formed between second wall section side edges of two adjacent building blocks, and at least part of first wall surfaces 124*a*, 124*c* (of such adjacent blocks), again, when building blocks 110 are fully connected one adjacent another.

Referring now more particularly to FIG. 4B, there is shown that hollow main body 114 further defines receiving grooves 164*a*, 164*b*, 164*c* inbetween spaced apart projections 130*a*, 130*b*, 130*c*, 130*d* and about upper surface 118, that are configured to releasably connect with, or receive, the plurality of additional building components mentioned above.

Figure 6A:
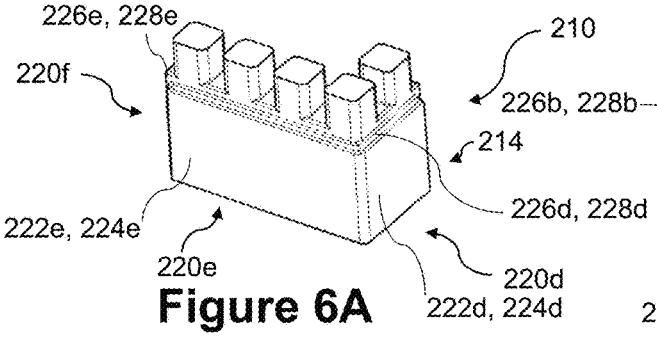
FIG. 6A is a top perspective view of a five-head building block (right corner building block) in accordance with another embodiment.
Figure 6B:
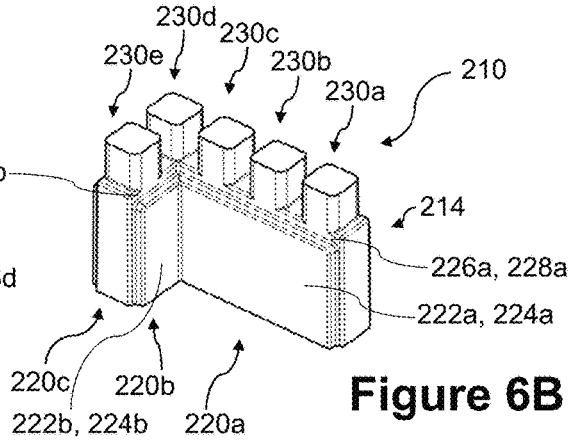
FIG. 6B is another top perspective view of the five-head building block shown in FIG. 6A.
Figure 6C:
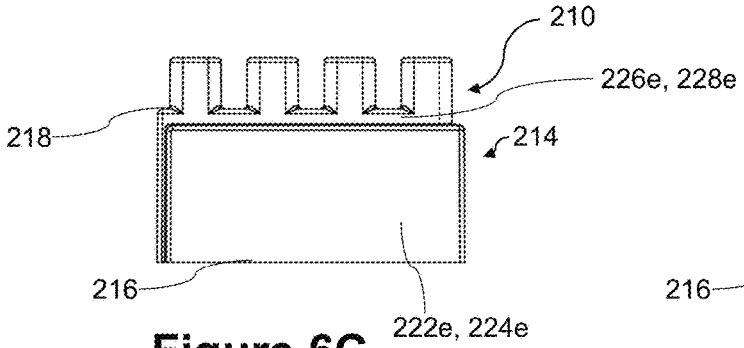
FIG. 6C is a front elevation view of the five-head building block shown in FIGS. 6A-6B.
Figure 6D:
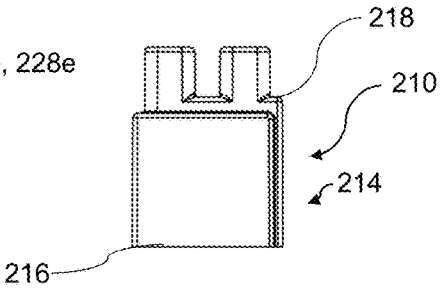
FIG. 6D is a side elevation view of the five-head building block shown in FIGS. 6A-6B.
Figure 6E:
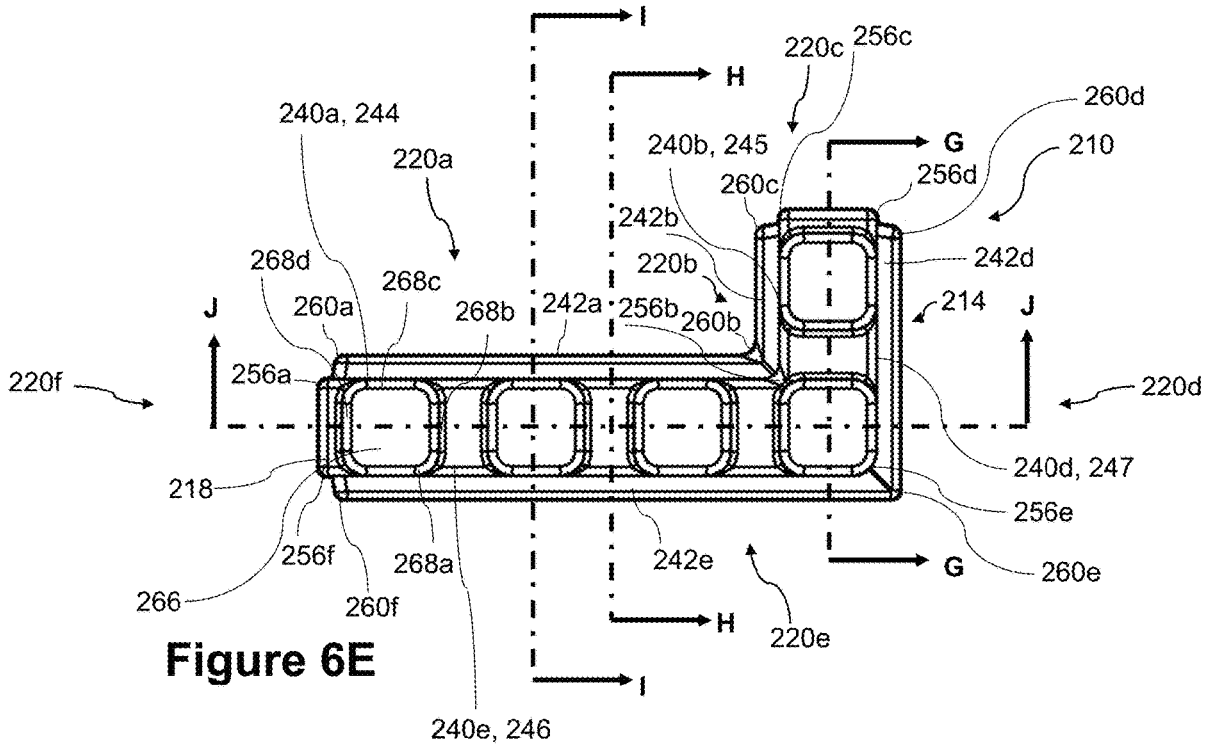
FIG. 6E is a top plan view of the five-head building block shown in FIGS. 6A-6B.
Figure 6F:
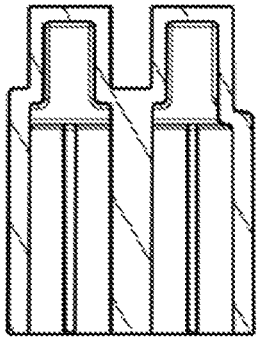
FIG. 6F is a cross-sectional view of the five-head building block shown in FIG. 6E, taken along line G-G.
Figure 6G:
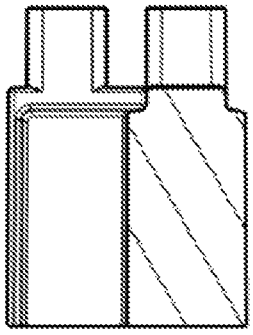
FIG. 6G is a cross-sectional view of the five-head building block shown in FIG. 6E, taken along line H-H.
Figure 6H:
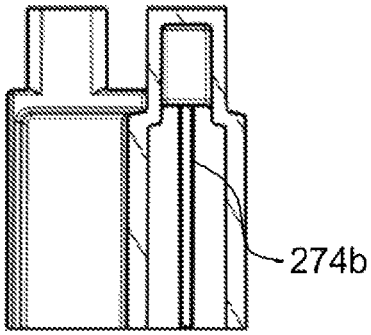
FIG. 6H is a cross-sectional view of the five-head building block shown in FIG. 6E, taken along line I-I.
Figure 6I:
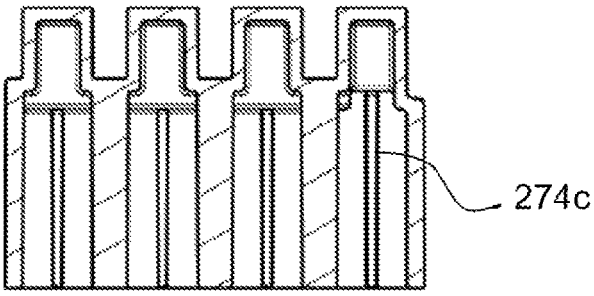
FIG. 6I is a cross-sectional view of the five-head building block shown in FIG. 6E, taken along line J-J.

Referring now more particularly to FIG. 6E, there is shown that each one of the spaced apart projections 130*a*, 130*b*, 130*c*, 130*d* comprises a projection upper surface 166, defining a substantially squared surface, and projection walls 168*a*, 168*b*, 168*c*, 168*d*, joining projection upper surface 166 and upper surface 118 of hollow main body 114. For each one of the spaced apart projections, or heads, 130*a*, 130*b*, 130*c*, 130*d*, two of the four projection walls, namely projection walls 168*a*, 168*c*, extend from upper surface 118 respectively at the upper surface first and second longitudinal edges 144, 148. Therefore, as shown, projection walls 168*a* share the same plan with first wall surface 124*a* of wall 120*a*, while projection walls 168*c* share the same plan with first wall surface 124*c* of wall 120*c*.

Figure 6J:
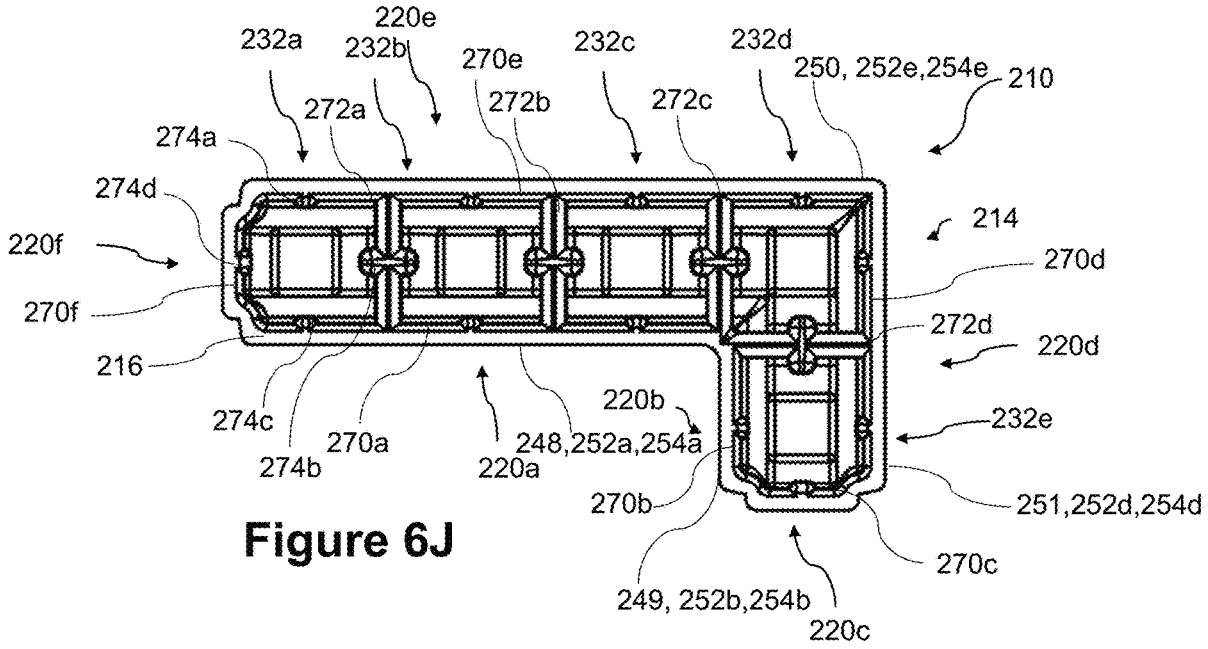
FIG. 6J is a bottom plan view of the five-head building block shown in FIGS. 6A-6B.

Referring now more particularly to FIG. 6J, there is shown that hollow main body 114 defines wall inner surfaces 170*a*, 170*b*, 170*c*, 170*d*. Building block 110 also further comprises inner wall 172*a*, 172, 172*c* within hollow main body 114. Inner wall 172*a*, 172*b*, 172*c* extend from lower surface 116 towards upper surface 118 and join together walls 120*a*, 120*c*. Inner walls 172*a*, 172*b*, 172*c*, 172*d*, together with walls 120*a*, 120*b*, 120*c*, 120*d*, form the spaced apart recess sections 132*a*, 132*b*, 132*c*, 132*d*.

Building block 110, as defined above, further comprises inner longitudinal protrusions (four inner longitudinal protrusions 174*a*, 174*b*, 174*c*, 174*d* for each one of the recess sections 132*a*, 132*b*, 132*c*, 132*d*). Each one of the inner longitudinal protrusions 174*a*, 174*b*, 174*c*, 174*d* longitudinally extends from lower surface 116 towards upper surface 118. Only some of the inner longitudinal protrusions, namely protrusions 174*a*, 174*c*, extend outwardly from wall inner surfaces 170*a*, 170*c*, while the remaining ones extend outwardly from inner walls 172*a*, 172*b*, 172*c*. Each one of the inner longitudinal protrusions 174*a*, 174*b*, 174*c*, 174*d* is adapted to interface with a corresponding one of projection walls 168*a*, 168*b*, 168*c*, 168*d* when a lower building block 110 is fully connected to an upper building block 110, or to any other similar building block (and where one or more of the spaced apart projection(s) is in alignment with a corresponding one of the one or more spaced apart recess sections).

Referring now more particularly to FIGS. 6A to 6J, there is shown a five-head L-shaped building block 210, or building block 210 (right corner building block). Building block 210 comprises an elongated L-shaped hollow main body 214 defining a lower surface 216, which is adapted to support hollow main body 214, and an upper surface 218, opposite lower surface 216. Building block 210 further comprises six walls 220*a*, 220*b*, 220*c*, 220*d*, 220*e*, 220*f* that together join lower surface 216 and upper surface 218. As best shown in FIGS. 6A and 6B, some of the walls 220*a*, 220*b*, 220*c*, 220*d*, 220*e*, 220*f*, namely walls 220*a*, 220*b*, 220*d*, 220*e*, each comprises a first wall section 322*a*, 322*b*, 322*d*, 322*e* which defines a first wall surface 224*a*, 224*b*, 224*d*, 224*e*, as well as a second wall section 226*a*, 226*b*, 226*d*, 226*e*, which defines a second wall surface 228*a*, 228*b*, 228*d*, 228*e*. Second wall surfaces 228*a*, 228*b*, 228*d*, 228*e* are parallel to and distant from first wall surfaces 224*a*, 224*b*, 224*d*, 224*e* (second wall surface 228*a* is parallel to and distant from first wall surface 224*a*, second wall surface 228*b* is parallel to and distant from first wall surfaces 224*b*, second wall surface 228*d* is parallel to and distant from first wall surfaces 224*d* and second wall surface 228*e* is parallel to and distant from first wall surfaces 224*e*).

Still referring to FIGS. 6A to 6J, there is shown that building block 210 further comprises spaced apart projections or heads 230*a*, 230*b*, 230*c*, 230*d*, 230*e* that extend from upper surface 218 in a direction opposite lower surface 216. Building block 210 further comprises spaced apart recess sections 232*a*, 232*b*, 232*c*, 232*d*, 232*e* disposed within hollow main body 214 about lower surface 216. Each one of the spaced apart recess sections 232*a*, 232*b*, 232*c*, 232*d*, 232*e* is being in a substantial alignment with a corresponding one of the spaced apart projections 230*a*, 230*b*, 230*c*, 230*d*, 230*e*.

According to the configuration of building block 210, when at least one of the spaced apart projections 230*a*, 230*b*, 230*c*, 230*d*, 230*e* of a lower building block 210 is releasably connected to at least one of the spaced apart recess sections 232*a*, 232*b*, 232*c*, 232*d*, 232*e* of an upper building block 210 (or to any other similar building block 10, 110, 210, 310, 410, 510, 610), an horizontally oriented longitudinal groove 34 is provided/created between second wall section 226*a*, 226*b*, 226*d*, 226*e* of lower building block 210 and hollow main body 214 of upper building block 210 when lower building block 210 is fully connected to upper building block 210 (FIG. 5A as shown with blocks 110).

Still referring to FIGS. 6A to 6J, there is shown that first wall sections 222*a*, 222*b*, 222*d*, 222*e* each defines a first surface area and second wall sections 226*a*, 226*b*, 226*d*, 226*e* each defines a second surface area and that the second surface areas are being greater than the first surface areas. Each one of the first wall sections 222*a*, 222*b*, 222*d*, 222*e* further defines a first wall section upper longitudinal edge 242*a*, 242*b*, 242*d*, 242*e* and each one of the second wall sections 226*a*, 226*b*, 226*d*, 226*e* defines a second wall section upper longitudinal edge 240*a*, 240*b*, 240*d*, 240*e*. Therefore, horizontally oriented longitudinal groove 34 is formed between second first wall section upper longitudinal edges 242*a*, 242*b*, 242*d*, 242*e* (of lower building block 210), at least part of first wall surfaces 224*a*, 224*b*, 224*d*, 224*e* (of lower building block 210) and lower surface 216 of hollow main body 214 of upper building block 210, again, when building blocks 210 are fully connected one to another (or with similar building blocks).

Still referring to FIGS. 6A to 6J, there is shown that upper surface 218 defines an upper surface first longitudinal edge 244, an upper surface second longitudinal edge 246, which is distant from upper surface first longitudinal edge 244. Upper surface 218 further defines an upper surface third longitudinal edge 245, an upper surface fourth longitudinal edge 247, which is distant from upper surface third longitudinal edge 245, thus defining the L-shaped configuration. As best shown in FIG. 6E, second wall section upper longitudinal edges 240*a*, 240*b*, 240*d*, 240*e* respectively correspond to upper surface first, third, fourth and second longitudinal edges 344, 345, 347, 346. Moreover, there is shown that first wall section upper longitudinal edges 242*a*, 242*b*, 242*d*, 242*e* are parallel to and distant from upper surface first, third, fourth and second longitudinal edges 344, 345, 347, 346 respectively.

Still referring to FIGS. 6A to 6J, there is shown that lower surface 216 defines a lower surface first longitudinal edge 248 and a lower surface second longitudinal edge 250, which is distant from lower surface first longitudinal edge 248. Lower surface 216 further defines a lower surface third longitudinal edge 249 and a lower surface fourth longitudinal edge 251, which is distant from lower surface third longitudinal edge 249. Additionally, each one of the first wall sections 222*a*, 222*b*, 222*d*, 222*e* defines a first wall section lower edge 252*a*, 252*b*, 252*d*, 252*e* and each one of second wall sections 226*a*, 226*b*, 226*d*, 226*e* defines a second wall section lower longitudinal edge 254*a*, 254*b*, 254*d*, 254*e*. Both first wall section lower edges 252*a*, 252*b*, 252*d*, 252*e* and second wall section lower longitudinal edges 254*a*, 254*b*, 254*d*, 254*e* correspond to respectively lower surface first, third, fourth and second longitudinal edges 348, 349, 351, 350, respectively.

Each one of the first wall sections 222*a*, 222*b*, 222*d*, 222*e* further defines a first wall section side edge 256*a*, 256*b*, 256*c*, 256*d*, 256*e*, 256*f*. Similarly, each one of the second wall sections 226*a*, 226*b*, 226*d*, 226*e* further defines a second wall section side edge 260*a*, 260*b*, 260*c*, 260*d*, 260*e*, 260*f*. Therefore, according to the four-head building block 210 shown in FIGS. 6A to 6J, first wall section side edge 256*a* is at a distance from second wall section side edge 260*a* (wall 220*a*) and similarly, first wall section side edge 256*c* is at a distance from second wall section side edge 260*c* (wall 220*b*). Additionally, first wall section side edge 256*d* is at a distance from second wall section side edge 260*d* (wall 220*d*) and similarly, first wall section side edge 256*f* is at a distance from second wall section side edge 260*f* (wall 220*e*) (FIG. 6E). Therefore, similarly to blocks 210 shown in FIG. 5A, vertically oriented longitudinal groove 35 is formed between second wall section side edges of two adjacent building blocks, and at least part of first wall surfaces 224*a*, 224*b*, 224*d*, 224*e* (of such adjacent blocks), again, when building blocks 210 are fully connected one adjacent another.

Referring now more particularly to FIG. 6E, there is shown that each one of the spaced apart projections 230*a*, 230*b*, 230*c*, 230*d*, 230*e* comprises a projection upper surface 266, defining a substantially squared surface, and projection walls 268*a*, 268*b*, 268*c*, 268*d*, joining projection upper surface 266 and upper surface 218 of hollow main body 214. For each one of the spaced apart projections, or heads, 230*a*, 230*b*, 230*c*, 230*d*, 230*e*, two of the four projection walls, namely projection walls 268*a*, 268*c* (for projections 230*a*, 230*b*, 230*c*) or projection walls 268*b*, 268*c* (for projection 230*d*) or projection walls 268*b*, 268*d* (for projection 230*e*), extend from upper surface 218 respectively at the upper surface first and second longitudinal edges 244, 246 (for projections 230*a*, 230*b*, 230*c*), at the upper surface third and fourth longitudinal edges 245, 247 (for projections 230*e*) or at the upper surface second and fourth longitudinal edges 246, 247 (for projection 230*d*). Therefore, as shown, for projections 230*a*, 230*b*, 230*c*, projection walls 268*a* share the same plan with first wall surface 224*a* of wall 220*a*, while projection walls 268*c* share the same plan with first wall surface 224*e* of wall 220*e*. For projection 230*d*, projection wall 268*b* share the same plan with first wall surface 224*d* of wall 220*d*, while projection wall 268*c* share the same plan with first wall surface 224*e* of wall 220*e*. For projection 230*e*, projection wall 268*b* share the same plan with first wall surface 224*d* of wall 220*d*, while projection wall 268*d* share the same plan with first wall surface 224*b* of wall 220*b*.

Referring now more particularly to FIG. 6J, there is shown that hollow main body 214 defines wall inner surfaces 270*a*, 270*b*, 270*c*, 270*d*, 270*e*, 270*f*. Building block 210 also further comprises inner walls 272*a*, 272*b*, 272*c*, 272*d* within hollow main body 214. Inner walls 272*a*, 272*b*, 272*c*, 272*d* extend from lower surface 216 towards upper surface 218 and join together walls 220*a*, 220*b*, 220*d*, 220*e*. Inner walls 272*a*, 272*b*, 272*c*, 272*d*, together with walls 220*a*, 220*b*, 220*c*, 220*d*, 220*e*, 220*f* form the spaced apart recess sections 232*a*, 232*b*, 232*c*, 232*d*, 232*e*.

Building block 210, as defined above, further comprises inner longitudinal protrusions (four inner longitudinal protrusions 274*a*, 274*b*, 274*c*, 274*d* for each one of the recess sections 232*a*, 232*b*, 232*c*, 232*d*, 232*e*). Each one of the inner longitudinal protrusions 274*a*, 274*b*, 274*c*, 274*d* longitudinally extends from lower surface 216 towards upper surface 218. Some of the inner longitudinal protrusions extend outwardly from wall inner surfaces 270*a*, 270*b*, 270*c*, 270*d*, 270*e*, 270*f*, while the remaining ones extend outwardly from inner walls (or from both surfaces of inner walls) 272*a*, 272*b*, 272*c*, 272*d*. Each one of the inner longitudinal protrusions 274*a*, 274*b*, 274*c*, 274*d* is adapted to interface with a corresponding one of projection walls 268*a*, 268*b*, 268*c*, 268*d* when a lower building block 210 is fully connected to an upper building block 210, or another similar block (and where one or more of the spaced apart projection(s) is in alignment with a corresponding one of the one or more spaced apart recess sections).

Figure 7A:
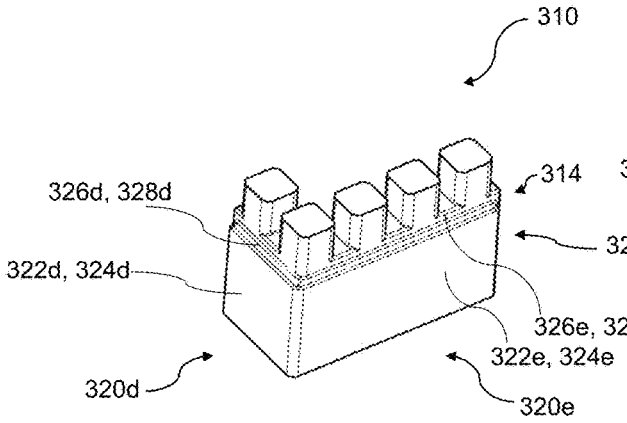
FIG. 7A is a top perspective view of another five-head building block (left corner building block) in accordance with a further embodiment.
Figure 7B:
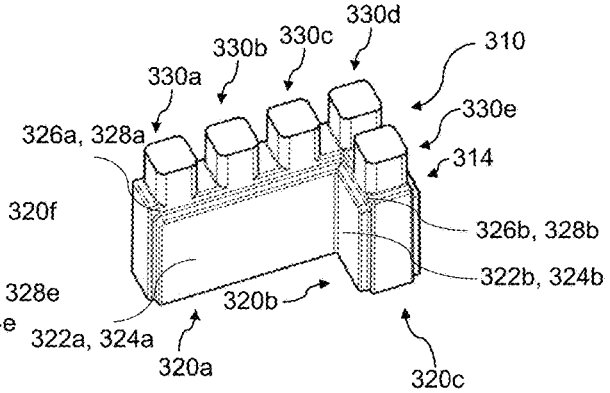
FIG. 7B is another top perspective view of the five-head building block shown in FIG. 7A.
Figure 7C:
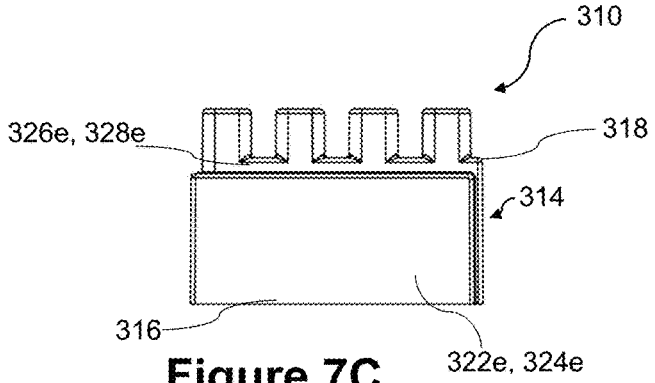
FIG. 7C is a front elevation view of the five-head building block shown in FIGS. 7A-7B.
Figure 7D:
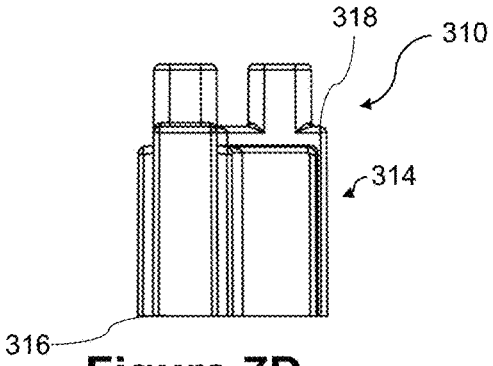
FIG. 7D is a side elevation view of the five-head building block shown in FIGS. 7A-7B.

Referring now more particularly to FIGS. 7A to 7I, there is shown a five-head L-shaped building block 310, or building block 310 (left corner building block). It is to be noted here that building block 310 is similar in shape to building block 210, with the exception that its L-shaped configuration is inverted. Indeed, building block 310 comprises an elongated L-shaped hollow main body 314 defining a lower surface 316, which is adapted to support hollow main body 314, and an upper surface 318, opposite lower surface 316. Building block 310 further comprises six walls 320*a*, 320*b*, 320*c*, 320*d*, 320*e*, 320*f* that together join lower surface 316 and upper surface 318. As best shown in FIGS. 7A and 7B, some of the walls 320*a*, 320*b*, 320*c*, 320*d*, 320*e*, 320*f*, namely walls 320*a*, 320*b*, 320*d*, 320*e*, comprises a first wall section 322*a*, 322*b*, 322*d*, 322*e* which defines a first wall surface 324*a*, 324*b*, 324*d*, 324*e*, as well as a second wall section 326*a*, 326*b*, 326*d*, 326*e*, which defines a second wall surface 328*a*, 328*b*, 328*d*, 328*e*. Second wall surfaces 328*a*, 328*b*, 328*d*, 328*e* are parallel to and distant from first wall surfaces 324*a*, 324*b*, 324*d*, 324*e* (second wall surface 328*a* is parallel to and distant from first wall surfaces 324*a*, second wall surface 328*b* is parallel to and distant from first wall surfaces 324*b*, second wall surface 328*d* is parallel to and distant from first wall surfaces 324*d* and second wall surface 328*e* is parallel to and distant from first wall surfaces 324*e*).

Still referring to FIGS. 7A to 7I, there is shown that building block 310 further comprises spaced apart projections or heads 330*a*, 330*b*, 330*c*, 330*d*, 330*e* that extend from upper surface 318 in a direction opposite lower surface 316. Building block 310 further comprises spaced apart recess sections 332*a*, 332*b*, 332*c*, 332*d*, 332*e* disposed within hollow main body 314 about lower surface 316. Each one of the spaced apart recess sections 332*a*, 332*b*, 332*c*, 332*d*, 332*e* is being in a substantial alignment with a corresponding one of the spaced apart projections 330*a*, 330*b*, 330*c*, 330*d*, 330*e*.

According to the configuration of building block 310, when at least one of the spaced apart projections 330*a*, 330*b*, 330*c*, 330*d*, 330*e* of a lower building block 310 is releasably connected to at least one of the spaced apart recess sections 332*a*, 332*b*, 332*c*, 332*d*, 332*e* of an upper building block 310 (or to any other similar building block 10, 110, 210, 310, 410, 510, 610), an horizontally oriented longitudinal groove 34 is provided/created between second wall section 126*a*, 126*b*, 126*d*, 126*e* of lower building block 310 and hollow main body 314 of upper building block 310 when lower building block 310 is fully connected to upper building block 310 (as best shown in FIG. 5A with building blocks 110).

Still referring to FIGS. 7A to 7I, there is shown that first wall sections 322*a*, 322*b*, 322*d*, 322*e* each defines a first surface area and second wall sections 326*a*, 326*b*, 326*d*, 326*e* each defines a second surface area and that the second surface areas are being greater than the first surface areas. Each one of the first wall sections 322*a*, 322*b*, 322*d*, 322*e* further defines a first wall section upper longitudinal edge 342*a*, 342*b*, 342*d*, 342*e* and each one of the second wall sections 326*a*, 326*b*, 326*d*, 326*e* defines a second wall section upper longitudinal edge 340*a*, 340*b*, 340*d*, 340*e*. Therefore, horizontally oriented longitudinal groove 34 is formed between second first wall section upper longitudinal edges 342*a*, 342*b*, 342*d*, 342*e* (of lower building block 310), at least part of first wall surfaces 324*a*, 324*b*, 324*d*, 324*e* (of lower building block 310) and lower surface 316 of hollow main body 314 of upper building block 310, again, when building blocks 310 are fully connected one to another.

Figure 7E:
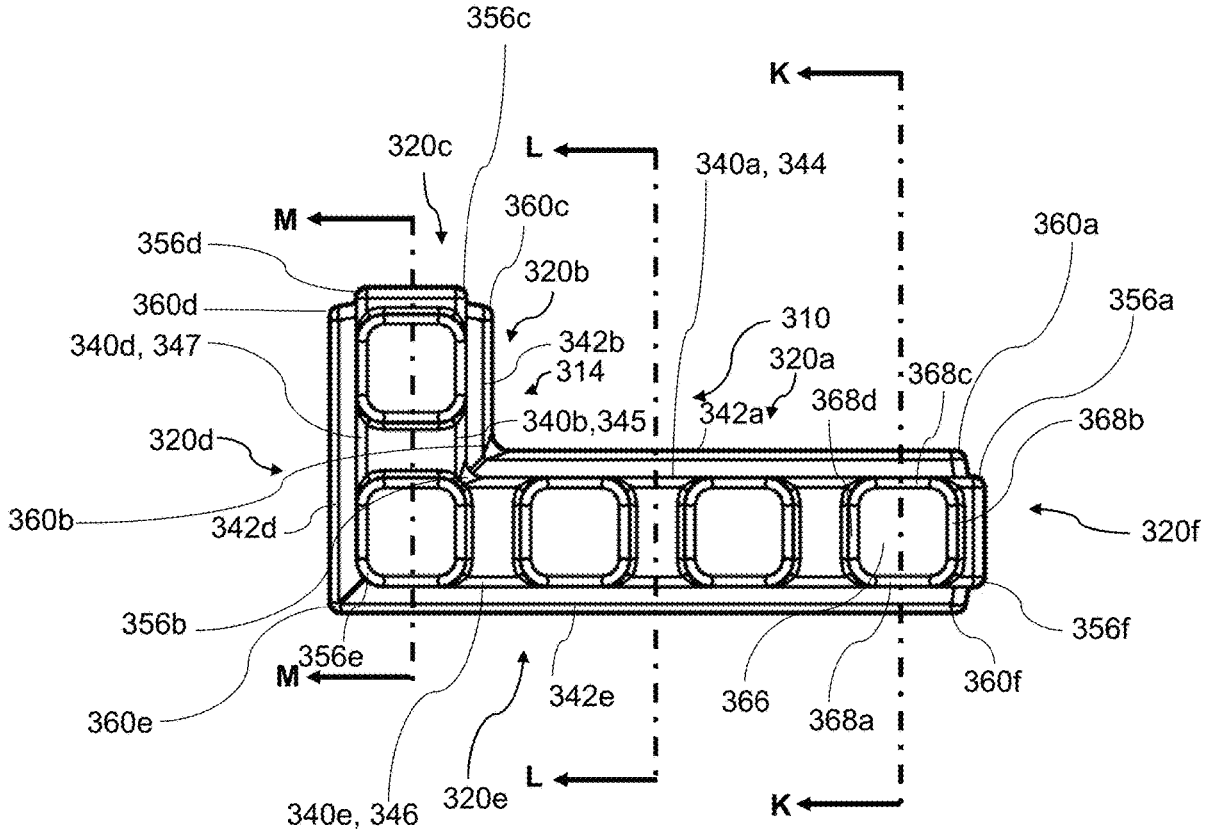
FIG. 7E is a top plan view of the five-head building block shown in FIGS. 7A-7B.
Figure 7F:
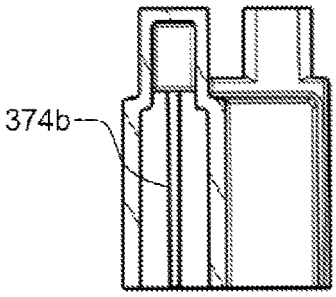
FIG. 7F is a cross-sectional view of the five-head building block shown in FIG. 7E, taken along line K-K.
Figure 7G:
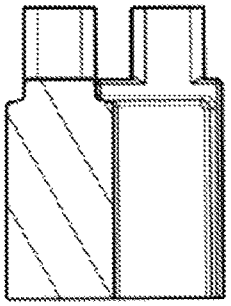
FIG. 7G is a cross-sectional view of the five-head building block shown in FIG. 7E, taken along line L-L.
Figure 7H:
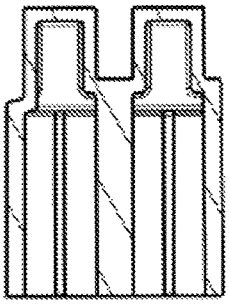
FIG. 7H is a cross-sectional view of the five-head building block shown in FIG. 7E, taken along line M-M.

Still referring to FIGS. 7A to 7I, there is shown that upper surface 318 defines an upper surface first longitudinal edge 344, an upper surface second longitudinal edge 346, which is distant from upper surface first longitudinal edge 344. Upper surface 318 further defines an upper surface third longitudinal edge 345, an upper surface fourth longitudinal edge 347, which is distant from upper surface third longitudinal edge 345. As best shown in FIG. 7E, second wall section upper longitudinal edges 340*a*, 340*b*, 340*d*, 340*e* respectively correspond to upper surface first, third, fourth and second longitudinal edges 344, 345, 347, 346, respectively. Moreover, there is shown that first wall section upper longitudinal edges 342*a*, 342*b*, 342*d*, 342*e* are parallel to and distant from upper surface first, third, fourth and second longitudinal edges 344, 345, 347, 346, respectively.

Still referring to FIGS. 7A to 7J, there is shown that lower surface 316 defines a lower surface first longitudinal edge 348 and a lower surface second longitudinal edge 350, which is distant from lower surface first longitudinal edge 348. Lower surface 316 further defines a lower surface third longitudinal edge 349 and a lower surface fourth longitudinal edge 351, which is distant from lower surface third longitudinal edge 349. Additionally, each one of the first wall sections 322*a*, 322*b*, 322*d*, 322*e* defines a first wall section lower edge 352*a*, 352*b*, 352*d*, 352*e* and each one of second wall sections 326*a*, 326*b*, 326*d*, 326*e* defines a second wall section lower longitudinal edge 354*a*, 354*b*, 354*d*, 354*e*. Both first wall section lower edges 352*a*, 352*b*, 352*d*, 352*e* and second wall section lower longitudinal edges 354*a*, 354*b*, 354*d*, 354*e* correspond to respectively lower surface first, third, fourth and second longitudinal edges 348, 349, 351, 350.

Each one of the first wall sections 322*a*, 322*b*, 322*d*, 322*e* further defines a first wall section side edge 356*a*, 356*b*, 356*c*, 356*d*, 356*e*, 356*f*. Similarly, each one of the second wall sections 326*a*, 326*b*, 326*d*, 326*e* further defines a second wall section side edge 360*a*, 360*b*, 360*c*, 360*d*, 360*e*, 360*f*. Therefore, according to the four-head building block 310 shown in FIGS. 7A to 7I, first wall section side edge 356*a* is at a distance from second wall section side edge 360*a* (wall 320*a*) and similarly, first wall section side edge 356*c* is at a distance from second wall section side edge 360*c* (wall 320*b*). Additionally, first wall section side edge 356*d* is at a distance from second wall section side edge 360*d* (wall 320*d*) and similarly, first wall section side edge 356*f* is at a distance from second wall section side edge 360*f* (wall 320*e*) (FIG. 7E). Therefore, similarly to blocks 110 shown in FIG. 5A, vertically oriented longitudinal groove 35 is formed between second wall section side edges of two adjacent building blocks, and at least part of first wall surfaces 324*a*, 324*b*, 324*d*, 324*e* (of such adjacent blocks), again, when building blocks 310 are fully connected one adjacent another.

Referring now more particularly to FIG. 7E, there is shown that each one of the spaced apart projections 330*a*, 330*b*, 330*c*, 330*d*, 330*e* comprises a projection upper surface 366, defining a substantially squared surface, and projection walls 368*a*, 368*b*, 368*c*, 368*d*, joining projection upper surface 366 and upper surface 318 of hollow main body 314. For each one of the spaced apart projections, or heads, 330*a*, 330*b*, 330*c*, 330*d*, 330*e*, two of the four projection walls, namely projection walls 368*a*, 368*c* (for projections 330*a*, 330*b*, 330*c*) or projection walls 368*b*, 368*c* (for projection 330*d*) or projection walls 368*b*, 368*d* (for projection 330*e*), extend from upper surface 318 respectively at the upper surface first and second longitudinal edges 344, 348 (for projections 330*a*, 330*b*, 330*c*), at the upper surface third and fourth longitudinal edges 345, 349 (for projections 330*e*) or at the upper surface second and fourth longitudinal edges 348, 349 (for projection 330*d*). Therefore, as shown, for projections 330*a*, 330*b*, 330*c*, projection walls 368*a* share the same plan with first wall surface 324*a* of wall 320*a*, while projection walls 368*c* share the same plan with first wall surface 324*e* of wall 320*e*. For projection 330*d*, projection wall 368*b* share the same plan with first wall surface 324*d* of wall 320*d*, while projection wall 368*c* share the same plan with first wall surface 324*e* of wall 320*e*. For projection 330*e*, projection wall 368*b* share the same plan with first wall surface 324*d* of wall 320*d*, while projection wall 368*d* share the same plan with first wall surface 324*b* of wall 320*b*.

Figure 7I:
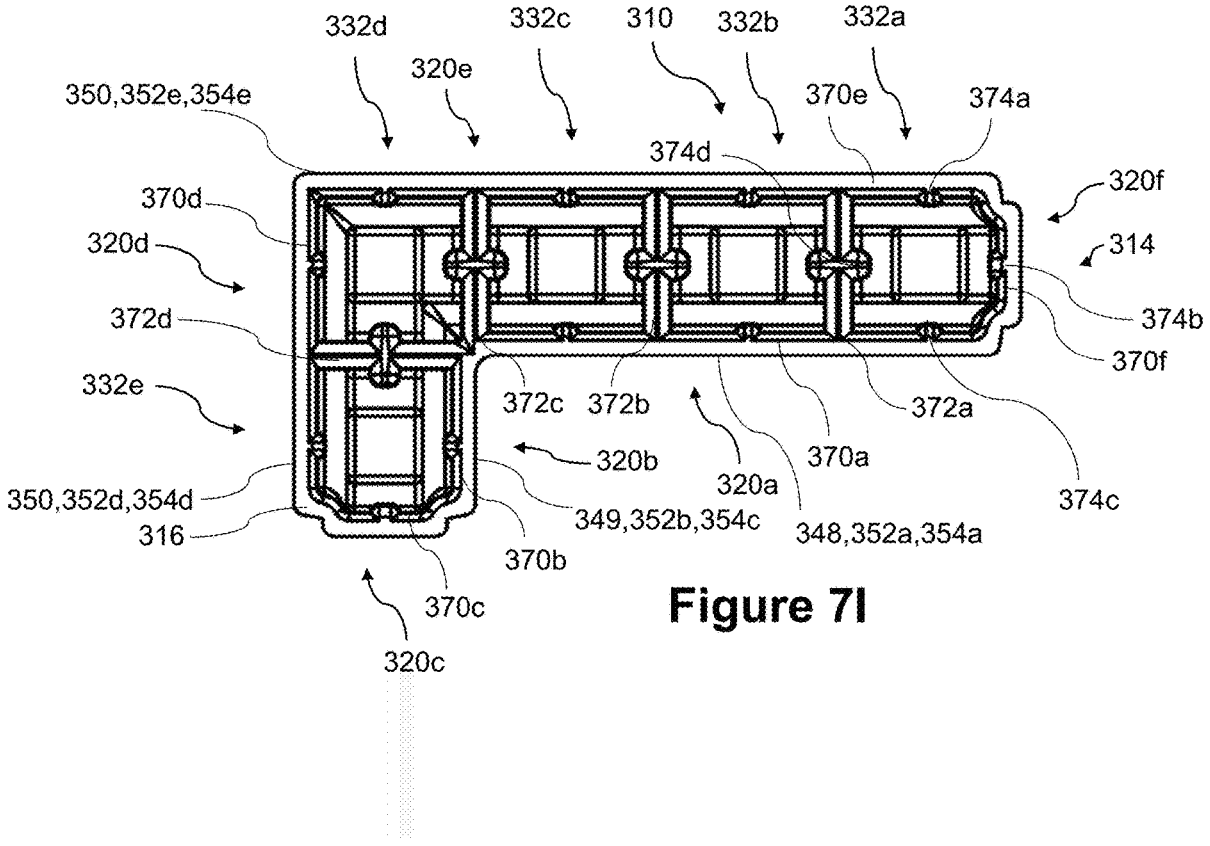
FIG. 7I is a bottom plan view of the five-head building block shown in FIGS. 7A-7B.

Referring now more particularly to FIG. 7I, there is shown that hollow main body 314 defines wall inner surfaces 370*a*, 370*b*, 370*c*, 370*d*, 370*e*, 370*f*. Building block 310 also further comprises inner walls 372*a*, 372*b*, 372*c*, 372*d* within hollow main body 314. Inner walls 372*a*, 372*b*, 372*c*, 372*d* extend from lower surface 316 towards upper surface 318 and join together walls 320*a*, 320*b*, 320*d*, 320*e*. Inner walls 372*a*, 372*b*, 372*c*, 372*d*, together with walls 320*a*, 320*b*, 320*c*, 320*d*, 320*e*, 320*f* form the spaced apart recess sections 332*a*, 332*b*, 332*c*, 332*d*, 332*e*.

Building block 310, as defined above, further comprises inner longitudinal protrusions (four inner longitudinal protrusions 374*a*, 374*b*, 374*c*, 374*d* for each one of the recess sections 332*a*, 332*b*, 332*c*, 332*d*, 332*e*). Each one of the inner longitudinal protrusions 374*a*, 374*b*, 374*c*, 374*d* longitudinally extends from lower surface 316 towards upper surface 318. Some of the inner longitudinal protrusions extend outwardly from wall inner surfaces 370*a*, 370*b*, 370*c*, 370*d*, 370*e*, 370*f*, while the remaining ones extend outwardly from inner walls 372*a*, 372*b*, 372*c*, 372*d* (or from both surfaces of inner walls). Each one of the inner longitudinal protrusions 374*a*, 374*b*, 374*c*, 374*d* is adapted to interface with a corresponding one of projection walls 368*a*, 368*b*, 368*c*, 368*d* when a lower building block 310 is fully connected to an upper building block 310 or to any other similar block (and where one or more of the spaced apart projection(s) is in alignment with a corresponding one of the one or more spaced apart recess sections).

Figures 8A, 8B:
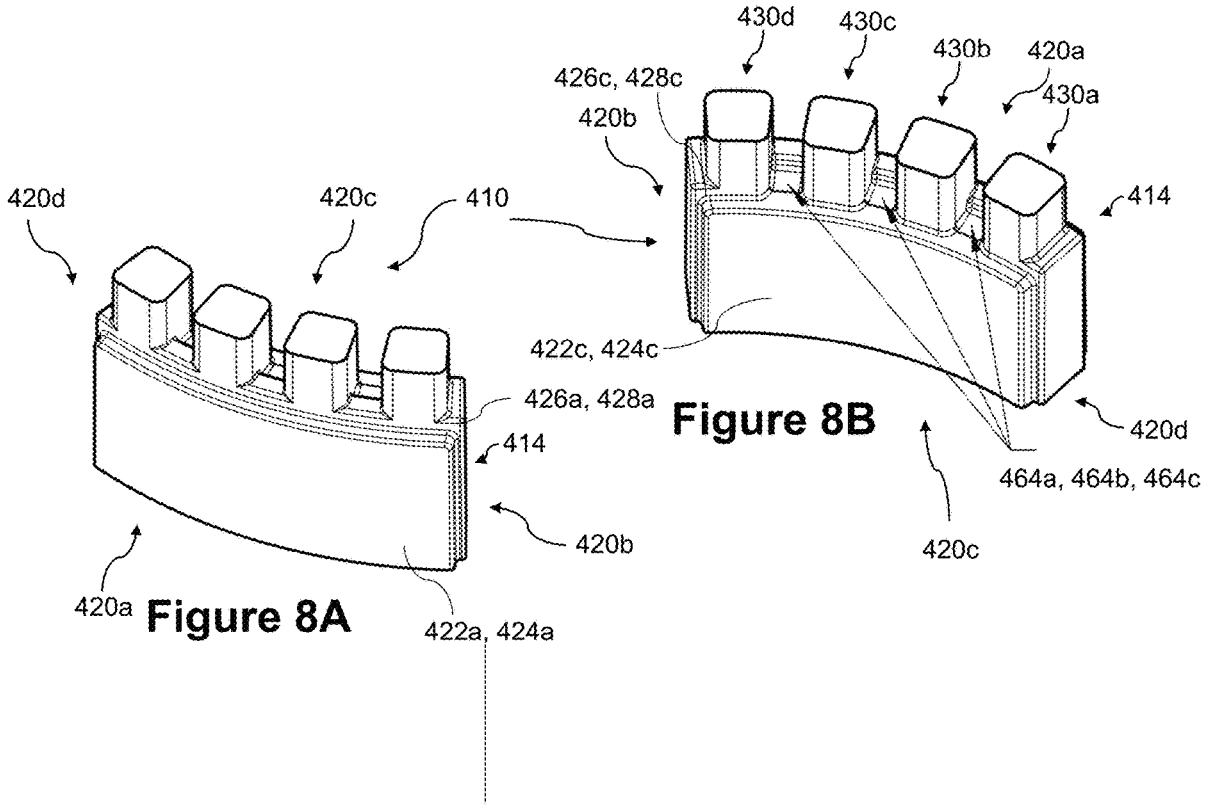
FIG. 8A is a top perspective view of a curved four-head building block in accordance with yet another embodiment.
FIG. 8B is another top perspective view of the curved four-head building block shown in FIG. 8A.
Figure 8C:
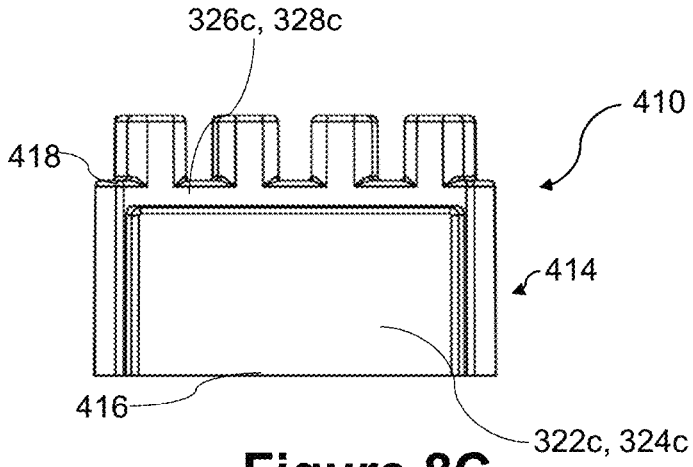
FIG. 8C is a front elevation view of the curved four-head building block shown in FIGS. 8A-8B.
Figure 8D:
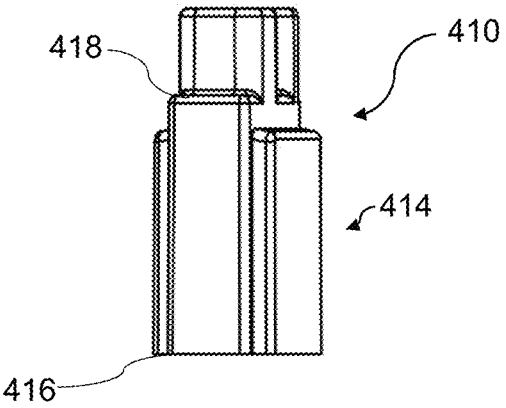
FIG. 8D is a side elevation view of the curved four-head building block shown in FIGS. 8A-8B.

Referring now more particularly to FIGS. 8A to 8I, there is shown a curved four-head building block 410, or building block 410. Indeed, building block 410 comprises an elongated and curved hollow main body 414 defining a lower surface 416, which is adapted to support hollow main body 414, and an upper surface 418, opposite lower surface 416. Building block 410 further comprises four walls 420*a*, 420*b*, 420*c*, 420*d* that together join lower surface 416 and upper surface 418. As best shown in FIGS. 8A and 8B, some of the walls 420*a*, 420*b*, 420*c*, 420*d*, namely walls 420*a*, 420*c*, each comprises a first wall section 422*a*, 422*c* which defines a first wall surface 424*a*, 424*c*, as well as a second wall section 426*a*, 426*c*, which defines a second wall surface 428*a*, 428*c*. Second wall surfaces 428*a*, 428*c* are parallel to and distant from first wall surfaces 424*a*, 424*c* (second wall surface 428*a* is parallel to and distant from first wall surfaces 424*a*, while second wall surface 428*c* is parallel to and distant from first wall surfaces 424*c*).

Still referring to FIGS. 8A to 8I, there is shown that building block 410 further comprises spaced apart projections or heads 430*a*, 430*b*, 430*c*, 430*d* that extend from upper surface 418 in a direction opposite lower surface 416. Building block 410 further comprises spaced apart recess sections 432*a*, 432*b*, 432*c*, 432*d* disposed within hollow main body 414 about lower surface 416. Each one of the spaced apart recess sections 432*a*, 432*b*, 432*b*, 432*c* is being in a substantial alignment with a corresponding one of the spaced apart projections 430*a*, 430*b*, 430*c*, 430*d*.

According to the configuration of building block 410, when at least one of the spaced apart projections 430*a*, 430*b*, 430*c*, 430*d* of a lower building block 410 is releasably connected to at least one of the spaced apart recess sections 432*a*, 432*b*, 432*c*, 432*d* of an upper building block 410 (or to any other similar building block 10, 110, 210, 310, 410, 510, 610), an horizontally oriented longitudinal groove 34 is provided/created between second wall section 426*a*, 426*c* of lower building block 410 and hollow main body 414 of upper building block 410 when lower building block 410 is fully connected to upper building block 410.

Still referring to FIGS. 8A to 8I, there is shown that first wall sections 422*a*, 422*c* each defines a first surface area and second wall sections 426*a*, 426*c* each defines a second surface area, and that the second surface areas are being greater than the first surface areas. Each one of the first wall sections 422*a*, 422*c* further defines a first wall section upper longitudinal edge 442*a*, 442*c* and each one of the second wall sections 426*a*, 426*c* defines a second wall section upper longitudinal edge 440*a*, 440*c*. Therefore, horizontally oriented longitudinal groove 34 is formed between first wall section upper longitudinal edges 442*a*, 442*c* (of lower building block 410), at least part of first wall surfaces 424*a*, 424*c* (of lower building block 410) and lower surface 416 of hollow main body 414 of upper building block 410, again, when building blocks 410 are fully connected one to another.

Figure 8E:
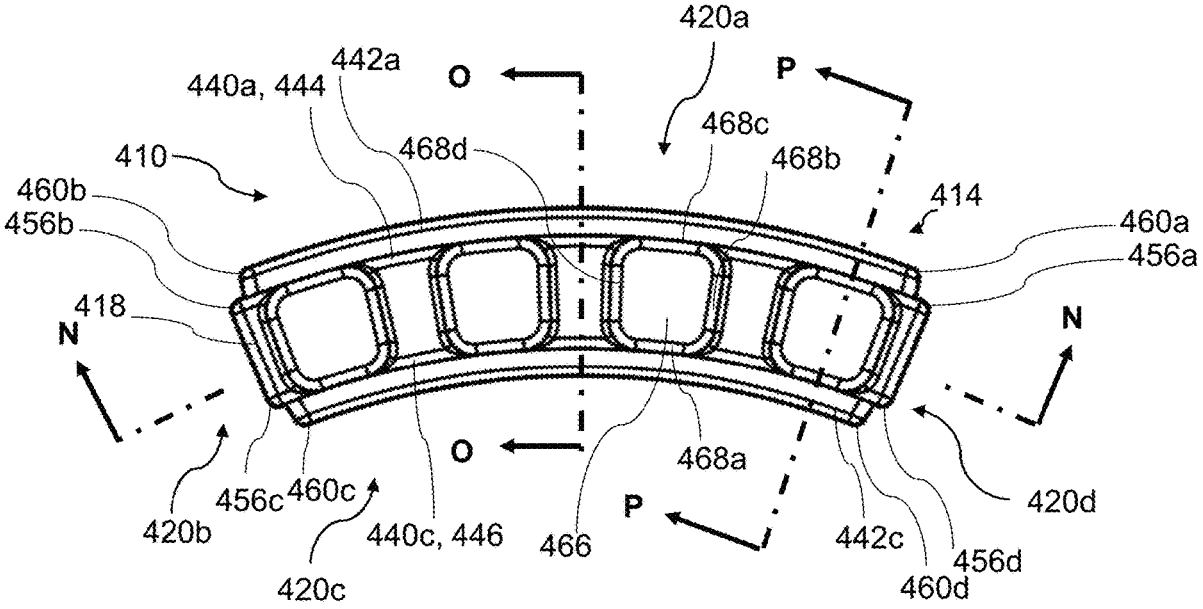
FIG. 8E is a top plan view of the curved four-head building block shown in FIGS. 8A-8B.
Figure 8F:
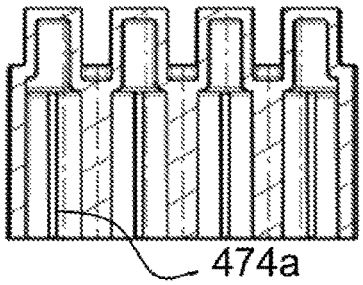
FIG. 8F is a cross-sectional view of the curved four-head building block shown in FIG. 8E, taken along line N-N.
Figure 8G:
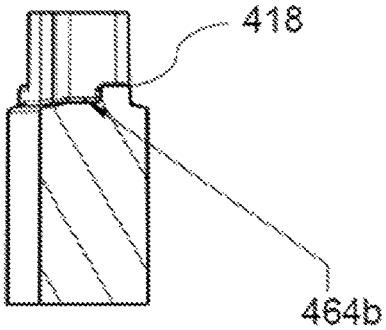
FIG. 8G is a cross-sectional view of the curved four-head building block shown in FIG. 8E, taken along line O-O.
Figure 8H:
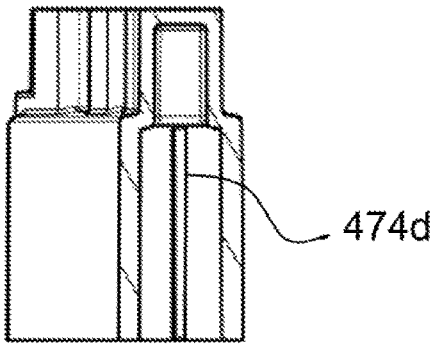
FIG. 8H is a cross-sectional view of the curved four-head building block shown in FIG. 8E, taken along line P-P.

Still referring to FIGS. 8A to 8I, there is shown that upper surface 418 defines an upper surface first longitudinal edge 444 and an upper surface second longitudinal edge 446, which is distant from upper surface first longitudinal edge 444. As best shown in FIG. 8E, second wall section upper longitudinal edges 440*a*, 440*c* respectively correspond to upper surface first and second longitudinal edges 444, 446. Moreover, there is shown that first wall section upper longitudinal edges 442*a*, 442*c* are parallel to and distant from upper surface first and second longitudinal edges 444, 446 respectively.

Still referring to FIGS. 8A to 8I, there is shown that lower surface 416 defines a lower surface first longitudinal edge 448 and a lower surface second longitudinal edge 450, which is distant from lower surface first longitudinal edge 448. Additionally, each one of the first wall sections 422*a*, 422*c* defines a first wall section lower edge 452*a*, 452*c* and each one of second wall sections 426*a*, 426*c* defines a second wall section lower longitudinal edge 454*a*, 454*c*. Both first wall section lower edges 452*a*, 452*c* and second wall section lower longitudinal edges 454*a*, 454*c* correspond to respectively lower surface first and second longitudinal edges 448, 450.

Each one of the first wall sections 422*a*, 422*c* further defines a first wall section side edge 456*a*, 456*b*, 456*c*, 456*d*. Similarly, each one of the second wall sections 426*a*, 426*c* further defines a second wall section side edge 460*a*, 460*b*, 460*c*, 460*d*. Therefore, according to the four-head building block 410 shown in FIGS. 8A to 8I, first wall section side edge 456*a* is at a distance from second wall section side edge 460*a* and similarly, first wall section side edge 456*b* is at a distance from second wall section side edge 460*b* (wall 420*a*). Additionally, first wall section side edge 456*c* is at a distance from second wall section side edge 460*c* and similarly, first wall section side edge 456*d* is at a distance from second wall section side edge 460*d* of wall 420*c* (FIG. 8E). Therefore, as best shown in FIG. 5A for blocks 110, similarly, vertically oriented longitudinal groove 35 is formed between second wall section side edges of two adjacent building blocks, and at least part of first wall surfaces 424*a*, 424*c* (of such adjacent blocks), again, when building blocks 410 are fully connected one adjacent another.

Referring now more particularly to FIG. 8B, there is shown that hollow main body 414 further defines receiving grooves 464*a*, 464*b*, 464*c* inbetween spaced apart projections 430*a*, 430*b*, 430*c*, 430*d* and about upper surface 418, that are configured to releasably connect with, or receive, the plurality of additional building components mentioned above.

Referring now more particularly to FIG. 8E, there is shown that each one of the spaced apart projections 430*a*, 430*b*, 430*c*, 430*d* comprises a projection upper surface 466, defining a substantially squared surface, and projection walls 468*a*, 468*b*, 468*c*, 468*d*, joining projection upper surface 466 and upper surface 418 of hollow main body 414. For each one of the spaced apart projections, or heads, 430*a*, 430*b*, 430*c*, 430*d*, two of the four projection walls, namely projection walls 468*a*, 468*c*, extend from upper surface 418 respectively at the upper surface first and second longitudinal edges 444, 448. Therefore, as shown, projection walls 468*a* share the same plan with first wall surface 424*a* of wall 420*a*, while projection walls 468*c* share the same plan with first wall surface 424*c* of wall 420*c*.

Figure 8I:
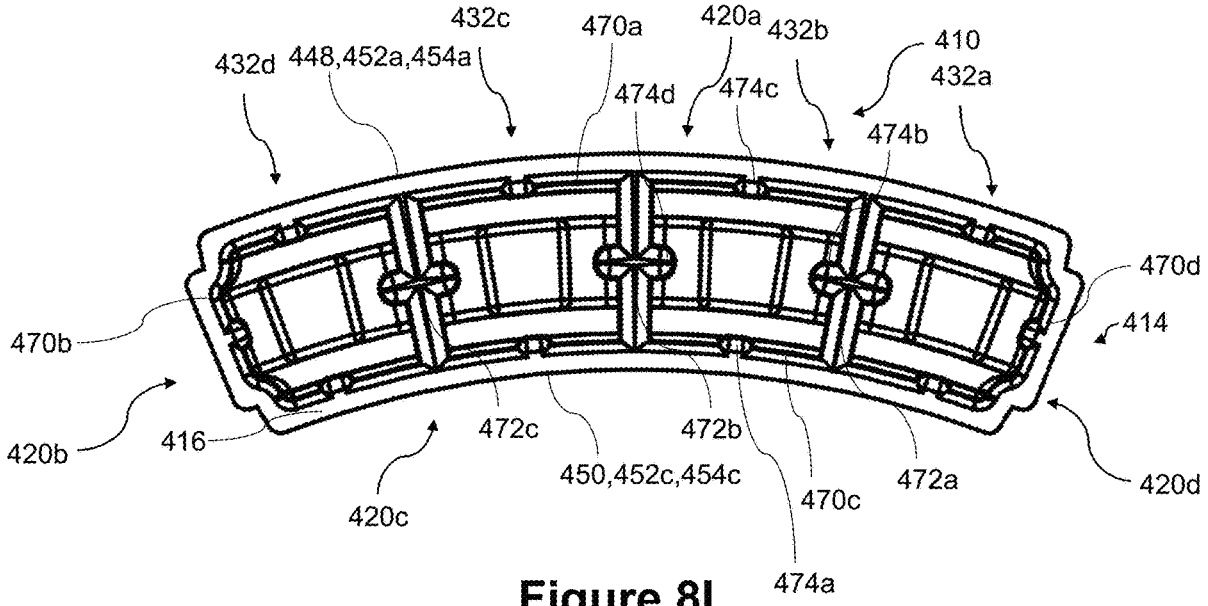
FIG. 8I is a bottom plan view of the curved four-head building block shown in FIGS. 8A-8B.

Referring now more particularly to FIG. 8I, there is shown that hollow main body 414 defines wall inner surfaces 470*a*, 470*b*, 470*c*, 470*d*. Building block 410 also further comprises inner wall 472*a*, 472, 472*c* within hollow main body 414. Inner wall 472*a*, 472*b*, 472*c* extend from lower surface 416 towards upper surface 418 and join together walls 420*a*, 420*c*. Inner walls 472*a*, 472*b*, 472*c*, 472*d*, together with walls 420*a*, 420*b*, 420*c*, 420*d*, form the spaced apart recess sections 432*a*, 432*b*, 432*c*, 432*d*.

Building block 410, as defined above, further comprises inner longitudinal protrusions (four inner longitudinal protrusions 474*a*, 474*b*, 474*c*, 474*d* for each one of the recess sections 432*a*, 432*b*, 432*c*, 432*d*). Each one of the inner longitudinal protrusions 474*a*, 474*b*, 474*c*, 474*d* longitudinally extends from lower surface 416 towards upper surface 418. Only some of the inner longitudinal protrusions, namely protrusions 474*a*, 474*c*, extend outwardly from wall inner surfaces 470*a*, 470*c*, while the remaining ones extend outwardly from inner walls 472*a*, 472*b*, 472*c*. Each one of the inner longitudinal protrusions 474*a*, 474*b*, 474*c*, 474*d* is adapted to interface with a corresponding one of projection walls 468*a*, 468*b*, 468*c*, 468*d* when a lower building block 410 is fully connected to an upper building block 410, or to any other similar building block (and where one or more of the spaced apart projection(s) is in alignment with a corresponding one of the one or more spaced apart recess sections).

Figure 9A:
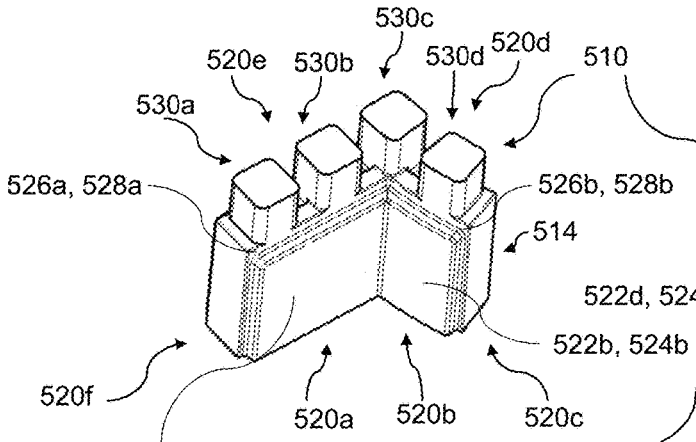
FIG. 9A is a top perspective view of another curved four-head building block (tower right corner building block) in accordance with another embodiment, where only two of the four heads are providing a curve to the building block.
Figure 9B:
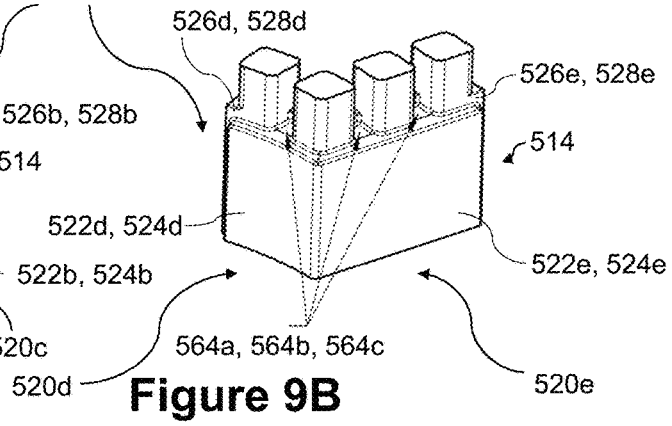
FIG. 9B is another top perspective view of the curved four-head building block shown in FIG. 9A.
Figure 9C:
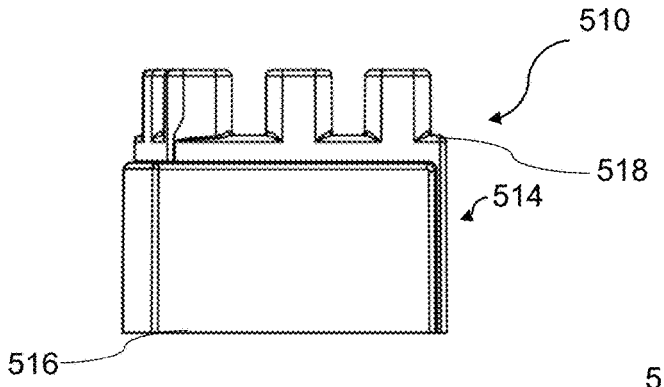
FIG. 9C is a front elevation view of the curved four-head building block shown in FIGS. 9A-9B.
Figure 9D:
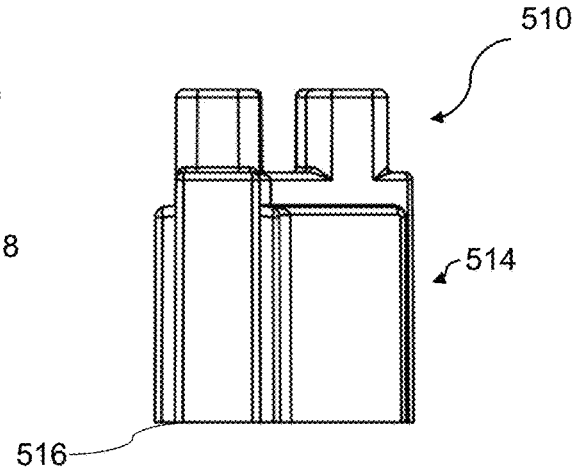
FIG. 9D is a side elevation view of the curved four-head building block shown in FIGS. 9A-9B.

Referring now more particularly to FIGS. 9A to 9I, there is shown a curved four-head building block 510, or building block 510 (tower right corner building block). Building block 510 comprises a substantially curved elongated L-shaped hollow main body 514 defining a lower surface 516, which is adapted to support hollow main body 514, and an upper surface 518, opposite lower surface 516. Building block 510 further comprises six walls 520*a*, 520*b*, 520*c*, 520*d*, 520*e*, 520*f* that together join lower surface 516 and upper surface 518. As best shown in FIGS. 9A and 9B, some of the walls 520*a*, 520*b*, 520*c*, 520*d*, 520*e*, 520*f*, namely walls 520*a*, 520*b*, 520*d*, 520*e*, comprises a first wall section 522*a*, 522*b*, 522*d*, 522*e* which defines a first wall surface 524*a*, 524*b*, 524*d*, 524*e*, as well as a second wall section 526*a*, 526*b*, 526*d*, 526*e*, which defines a second wall surface 528*a*, 528*b*, 528*d*, 528*e*. Second wall surfaces 528*a*, 528*b*, 528*d*, 528*e* are parallel to and distant from first wall surfaces 524*a*, 524*b*, 524*d*, 524*e* (second wall surface 528*a* is parallel to and distant from first wall surfaces 524*a*, second wall surface 528*b* is parallel to and distant from first wall surfaces 524*b*, second wall surface 528*d* is parallel to and distant from first wall surfaces 524*d* and second wall surface 528*e* is parallel to and distant from first wall surfaces 524*e*).

Still referring to FIGS. 9A to 9I, there is shown that building block 510 further comprises spaced apart projections or heads 530*a*, 530*b*, 530*c*, 530*d* that extend from upper surface 518 in a direction opposite lower surface 516. Building block 510 further comprises spaced apart recess sections 532*a*, 532*b*, 532*c*, 532*d*, disposed within hollow main body 514 about lower surface 516. Each one of the spaced apart recess sections 532*a*, 532*b*, 532*c*, 532*d* is being in a substantial alignment with a corresponding one of the spaced apart projections 530*a*, 530*b*, 530*c*, 530*d*.

According to the configuration of building block 510, when at least one of the spaced apart projections 530*a*, 530*b*, 530*c*, 530*d* of a lower building block 510 is releasably connected to at least one of the spaced apart recess sections 532*a*, 532*b*, 532*c*, 532*d* of an upper building block 510 (or to any other similar building block 10, 110, 210, 310, 410, 510, 610), an horizontally oriented longitudinal groove 34 is provided/created between second wall section 526*a*, 526*b*, 526*d*, 526*e* of lower building block 510 and hollow main body 514 of upper building block 510 when lower building block 510 is fully connected to upper building block 510 (as best shown in FIG. 5A with building blocks 110).

Still referring to FIGS. 9A to 9I, there is shown that first wall sections 522*a*, 522*b*, 522*d*, 522*e* each defines a first surface area and second wall sections 526*a*, 526*b*, 526*d*, 526*e* each defines a second surface area and that the second surface areas are being greater than the first surface areas. Each one of the first wall sections 522*a*, 522*b*, 522*d*, 522*e* further defines a first wall section upper longitudinal edge 542*a*, 542*b*, 542*d*, 542*e* and each one of the second wall sections 526*a*, 526*b*, 526*d*, 526*e* defines a second wall section upper longitudinal edge 540*a*, 540*b*, 540*d*, 540*e*. Therefore, horizontally oriented longitudinal groove 34 is formed between first wall section upper longitudinal edges 542*a*, 542*b*, 542*d*, 542*e* (of lower building block 510), at least part of first wall surfaces 524*a*, 524*b*, 524*d*, 524*e* (of lower building block 510) and lower surface 516 of hollow main body 514 of upper building block 510, again, when building blocks 510 are fully connected one to another.

Figure 9E:
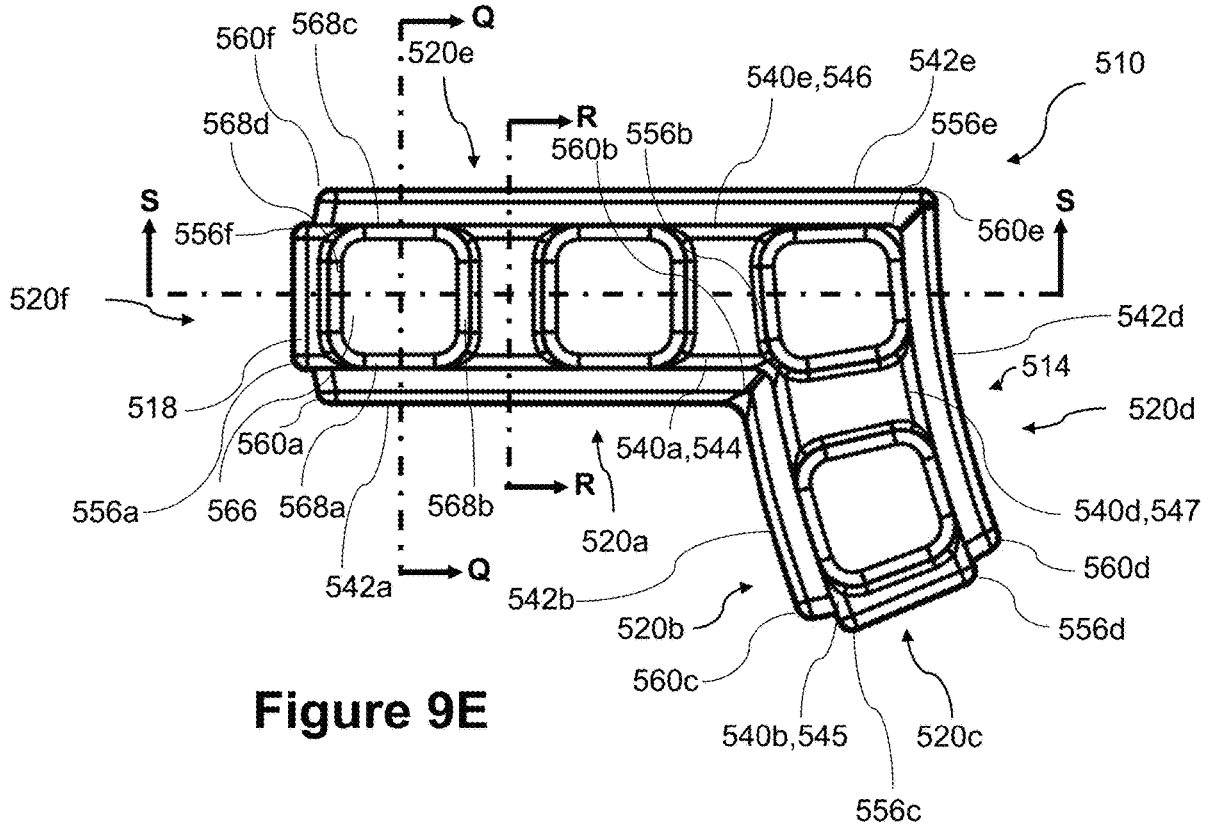
FIG. 9E is a top plan view of the curved four-head building block shown in FIGS. 9A-9B.
Figure 9F:
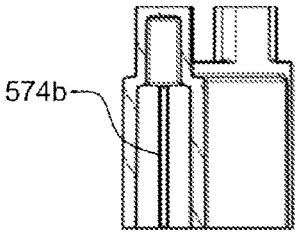
FIG. 9F is a cross-sectional view of the curved four-head building block shown in FIG. 9E, taken along line Q-Q.
Figure 9G:
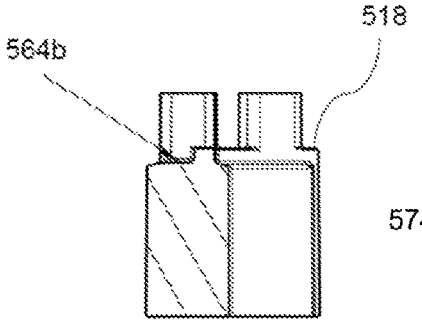
FIG. 9G is a cross-sectional view of the curved four-head building block shown in FIG. 9E, taken along line R-R.
Figure 9H:
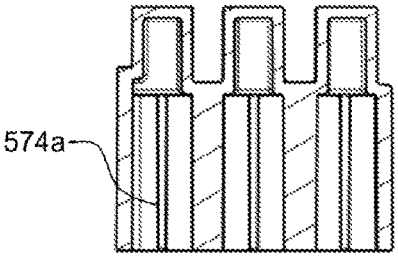
FIG. 9H is a cross-sectional view of the curved four-head building block shown in FIG. 9E, taken along line S-S.

Still referring to FIGS. 9A to 9I, there is shown that upper surface 518 defines an upper surface first longitudinal edge 544, an upper surface second longitudinal edge 546, which is distant from upper surface first longitudinal edge 544. Upper surface 518 further defines an upper surface third longitudinal edge 545, an upper surface fourth longitudinal edge 547, which is distant from upper surface third longitudinal edge 545. As best shown in FIG. 9E, second wall section upper longitudinal edges 540*a*, 540*b*, 540*d*, 540*e* respectively correspond to upper surface first, third, fourth and second longitudinal edges 544, 545, 547, 546, respectively. Moreover, there is shown that first wall section upper longitudinal edges 542*a*, 542*b*, 542*d*, 542*e* are parallel to and distant from upper surface first, third, fourth and second longitudinal edges 544, 545, 547, 546, respectively.

Still referring to FIGS. 9A to 9I, there is shown that lower surface 516 defines a lower surface first longitudinal edge 548 and a lower surface second longitudinal edge 550, which is distant from lower surface first longitudinal edge 548. Lower surface 516 further defines a lower surface third longitudinal edge 549 and a lower surface fourth longitudinal edge 551, which is distant from lower surface third longitudinal edge 549. Additionally, each one of the first wall sections 522*a*, 522*b*, 522*d*, 522*e* defines a first wall section lower edge 552*a*, 552*b*, 552*d*, 552*e* and each one of second wall sections 526*a*, 526*b*, 526*d*, 526*e* defines a second wall section lower longitudinal edge 554*a*, 554*b*, 554*d*, 554*e*. Both first wall section lower edges 552*a*, 552*b*, 552*d*, 552*e* and second wall section lower longitudinal edges 554*a*, 554*b*, 554*d*, 554*e* correspond to respectively lower surface first, third, fourth and second longitudinal edges 548, 549, 551, 550.

Each one of the first wall sections 522*a*, 522*b*, 522*d*, 522*e* further defines a first wall section side edge 556*a*, 556*b*, 556*c*, 556*d*, 556*e*, 556*f*. Similarly, each one of the second wall sections 526*a*, 526*b*, 526*d*, 526*e* further defines a second wall section side edge 560*a*, 560*b*, 560*c*, 560*d*, 560*e*, 560*f*. Therefore, according to the four-head building block 510 shown in FIGS. 9A to 9I, first wall section side edge 556*a* is at a distance from second wall section side edge 560*a* (wall 520*a*) and similarly, first wall section side edge 556*c* is at a distance from second wall section side edge 560*c* (wall 520*b*). Additionally, first wall section side edge 556*d* is at a distance from second wall section side edge 560*d* (wall 520*d*) and similarly, first wall section side edge 556*f* is at a distance from second wall section side edge 360*f* (wall 520*e*) (FIG. 9E). Therefore, similarly to blocks 110 shown in FIG. 5A, vertically oriented longitudinal groove 35 is formed between second wall section side edges of two adjacent building blocks, and at least part of first wall surfaces 524*a*, 524*b*, 524*d*, 524*e* (of such adjacent blocks), again, when building blocks 510 are fully connected one adjacent another.

Referring now more particularly to FIG. 9E, there is shown that each one of the spaced apart projections 530*a*, 530*b*, 530*c*, 530*d* comprises a projection upper surface 566, defining a substantially squared surface, and projection walls 568*a*, 568*b*, 568*c*, 568*d*, joining projection upper surface 566 and upper surface 518 of hollow main body 514. For each one of the spaced apart projections, or heads, 530*a*, 530*b*, 530*c*, 530*d* two of the four projection walls, namely projection walls 568*a*, 568*c* (for projections 530*a*, 530*b*) or projection walls 568*b*, 568*c* (for projection 530*c*) or projection walls 568*b*, 568*d* (for projection 530*d*), extend from upper surface 518 respectively at the upper surface first and second longitudinal edges 544, 548 (for projections 530*a*, 530*b*), at the upper surface third and fourth longitudinal edges 545, 549 (for projection 530*d*) or at the upper surface second and fourth longitudinal edges 548, 549 (for projection 530*c*). Therefore, as shown, for projections 530*a*, 530*b*, projection walls 568*a* share the same plan with first wall surface 524*a* of wall 520*a*, while projection walls 568*c* share the same plan with first wall surface 524*e* of wall 520*e*. For projection 530*c*, projection wall 568*b* share the same plan with first wall surface 524*d* of wall 520*d*, while projection wall 568*c* share the same plan with first wall surface 524*e* of wall 520*e*. For projection 530*d*, projection wall 568*b* share the same plan with first wall surface 524*d* of wall 520*d*, while projection wall 568*d* share the same plan with first wall surface 524*b* of wall 520*b*.

Figure 9I:
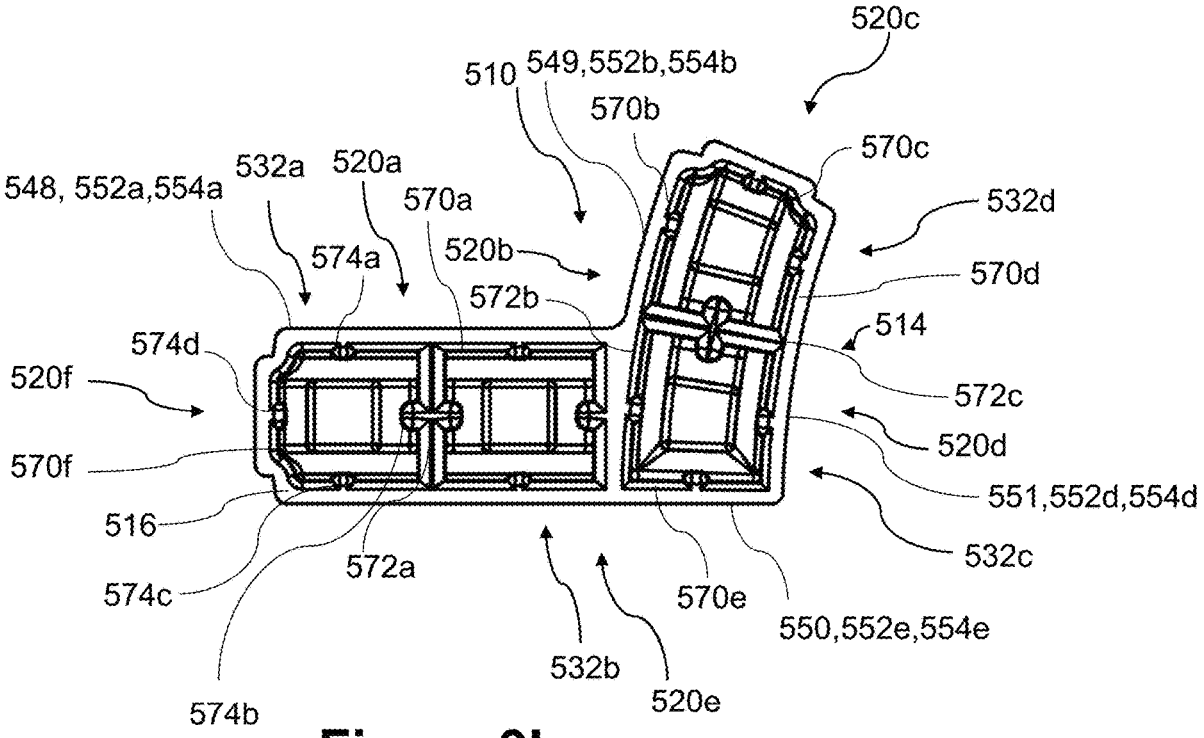
FIG. 9I is a bottom plan view of the curved four-head building block shown in FIGS. 9A-9B.

Referring now more particularly to FIG. 9I, there is shown that hollow main body 514 defines wall inner surfaces 570*a*, 570*b*, 570*c*, 570*d*, 570*e*, 570*f*. Building block 510 also further comprises inner walls 572*a*, 572*b*, 572*c* within hollow main body 514. Inner walls 572*a*, 572*b*, 572*c* extend from lower surface 516 towards upper surface 518 and join together walls 520*a*, 520*b*, 520*d*, 520*e*. Inner walls 572*a*, 572*b*, 572*c*, together with walls 520*a*, 520*b*, 520*c*, 520*d*, 520*e*, 520*f* form the spaced apart recess sections 532*a*, 532*b*, 532*c*, 532*d*.

Building block 510, as defined above, further comprises inner longitudinal protrusions (four inner longitudinal protrusions 574*a*, 574*b*, 574*c*, 574*d* for each one of the recess sections 532*a*, 532*b*, 532*c*, 532*d*). Each one of the inner longitudinal protrusions 574*a*, 574*b*, 574*c*, 574*d* longitudinally extends from lower surface 516 towards upper surface 518. Some of the inner longitudinal protrusions extend outwardly from wall inner surfaces 570*a*, 570*b*, 570*c*, 570*d*, 570*e*, 570*f*, while the remaining ones extend outwardly from inner walls 572*a*, 572*b*, 572*c* (or from both surfaces of inner walls). Each one of the inner longitudinal protrusions 574*a*, 574*b*, 574*c*, 574*d* is adapted to interface with a corresponding one of projection walls 568*a*, 568*b*, 568*c*, 568*d* when a lower building block 510 is fully connected to an upper building block 510 or to any other similar block (and where one or more of the spaced apart projection(s) is in alignment with a corresponding one of the one or more spaced apart recess sections).

Figure 10A:
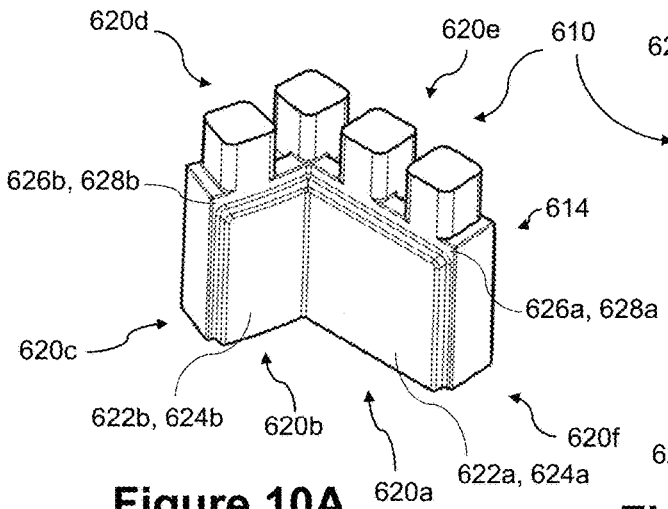
FIG. 10A is a top perspective view of a further curved four-head building block (tower left corner building block) in accordance with a further embodiment, where only two of the four heads are providing a curve to the building block.
Figure 10B:
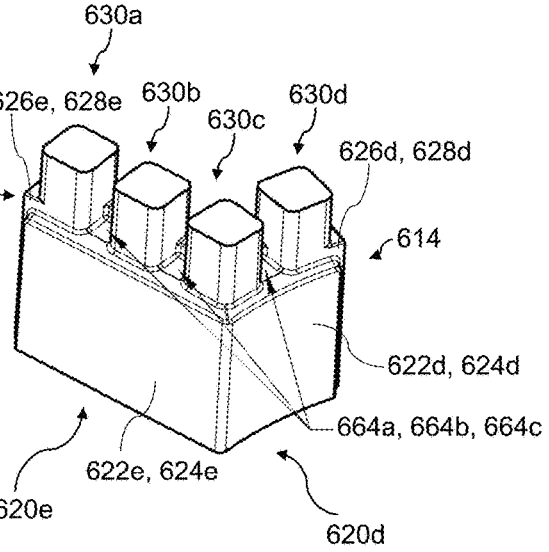
FIG. 10B is another top perspective view of the curved four-head building block shown in FIG. 10A.
Figure 10C:
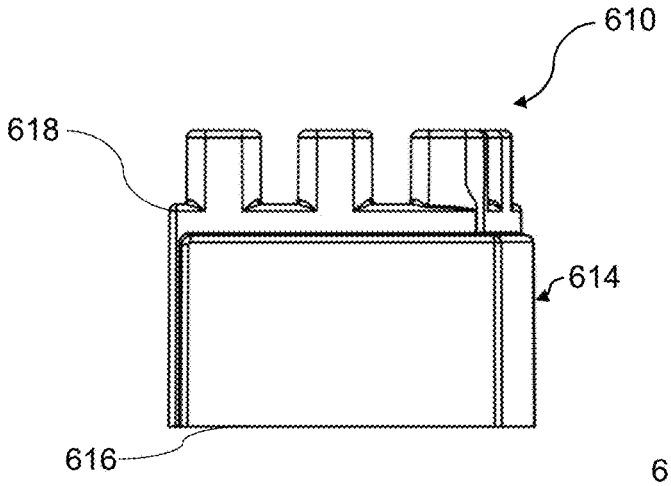
FIG. 10C is a front elevation view of the curved four-head building block shown in FIGS. 10A-10B.
Figure 10D:
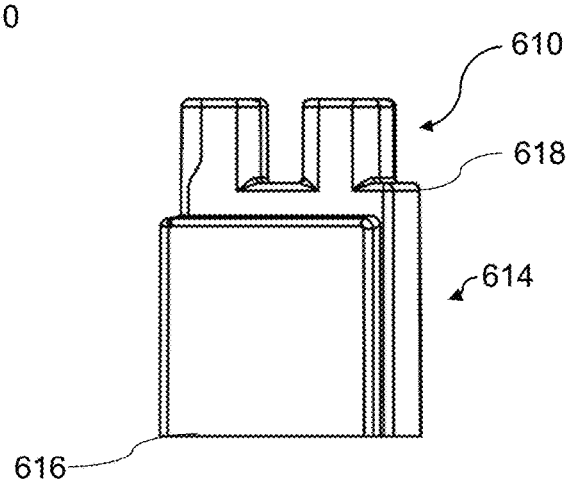
FIG. 10D is a side elevation view of the curved four-head building block shown in FIGS. 10A-10B.

Referring now more particularly to FIGS. 10A to 10I, there is shown an inverted curved four-head building block 610, or building block 610 (tower left corner building block). Building block 610 comprises a substantially curved elongated L-shaped hollow main body 614 defining a lower surface 616, which is adapted to support hollow main body 614, and an upper surface 618, opposite lower surface 616. Building block 610 further comprises six walls 620*a*, 620*b*, 620*c*, 620*d*, 620*e*, 620*f* that together join lower surface 616 and upper surface 618. As best shown in FIGS. 10A and 10B, some of the walls 620*a*, 620*b*, 620*c*, 620*d*, 620*e*, 620*f*, namely walls 620*a*, 620*b*, 620*d*, 620*e*, comprises a first wall section 622*a*, 622*b*, 622*d*, 622*e* which defines a first wall surface 624*a*, 624*b*, 624*d*, 624*e*, as well as a second wall section 626*a*, 626*b*, 626*d*, 626*e*, which defines a second wall surface 628*a*, 628*b*, 628*d*, 628*e*. Second wall surfaces 628*a*, 628*b*, 628*d*, 628*e* are parallel to and distant from first wall surfaces 624*a*, 624*b*, 624*d*, 624*e* (second wall surface 628*a* is parallel to and distant from first wall surfaces 624*a*, second wall surface 628*b* is parallel to and distant from first wall surfaces 624*b*, second wall surface 628*d* is parallel to and distant from first wall surfaces 624*d* and second wall surface 628*e* is parallel to and distant from first wall surfaces 624*e*).

Still referring to FIGS. 10A to 10I, there is shown that building block 610 further comprises spaced apart projections or heads 630*a*, 630*b*, 630*c*, 630*d* that extend from upper surface 618 in a direction opposite lower surface 616. Building block 610 further comprises spaced apart recess sections 632*a*, 632*b*, 632*c*, 632*d*, disposed within hollow main body 614 about lower surface 616. Each one of the spaced apart recess sections 632*a*, 632*b*, 632*c*, 632*d* is being in a substantial alignment with a corresponding one of the spaced apart projections 630*a*, 630*b*, 630*c*, 630*d*.

According to the configuration of building block 610, when at least one of the spaced apart projections 630*a*, 630*b*, 630*c*, 630*d* of a lower building block 610 is releasably connected to at least one of the spaced apart recess sections 632*a*, 632*b*, 632*c*, 632*d* of an upper building block 610 (or to any other similar building block 10, 110, 210, 310, 410, 510, 610), an horizontally oriented longitudinal groove 34 is provided/created between second wall section 626*a*, 626*b*, 626*d*, 626*e* of lower building block 610 and hollow main body 614 of upper building block 610 when lower building block 610 is fully connected to upper building block 610 (as best shown in FIG. 5A with building blocks 110).

Still referring to FIGS. 10A to 10I, there is shown that first wall sections 622*a*, 622*b*, 622*d*, 622*e* each defines a first surface area and second wall sections 626*a*, 626*b*, 626*d*, 626*e* each defines a second surface area and that the second surface areas are being greater than the first surface areas. Each one of the first wall sections 622*a*, 622*b*, 622*d*, 622*e* further defines a first wall section upper longitudinal edge 642*a*, 642*b*, 642*d*, 642*e* and each one of the second wall sections 626*a*, 626*b*, 626*d*, 626*e* defines a second wall section upper longitudinal edge 640*a*, 640*b*, 640*d*, 640*e*. Therefore, horizontally oriented longitudinal groove 34 is formed between first wall section upper longitudinal edges 642*a*, 642*b*, 642*d*, 642*e* (of lower building block 610), at least part of first wall surfaces 624*a*, 624*b*, 624*d*, 624*e* (of lower building block 610) and lower surface 616 of hollow main body 614 of upper building block 610, again, when building blocks 610 are fully connected one to another.

Figure 10E:
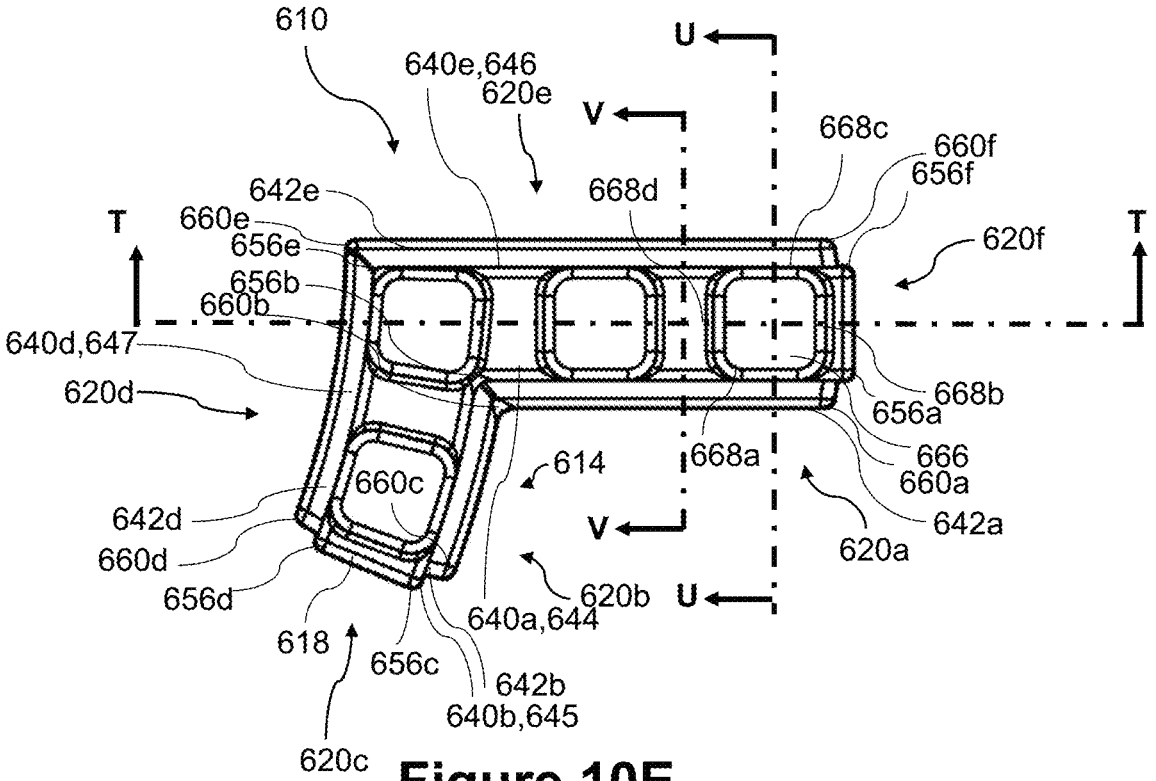
FIG. 10E is a top plan view of the curved four-head building block shown in FIGS. 10A-10B.
Figure 10F:
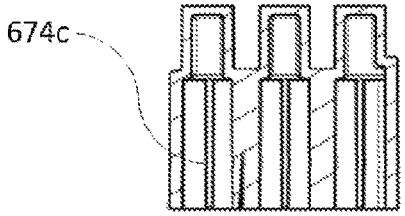
FIG. 10F is a cross-sectional view of the curved four-head building block shown in FIG. 10E, taken along line T-T.
Figure 10G:
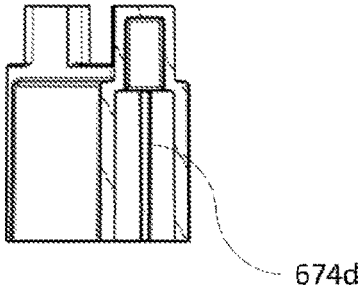
FIG. 10G is a cross-sectional view of the curved four-head building block shown in FIG. 10E, taken along line U-U.
Figure 10H:
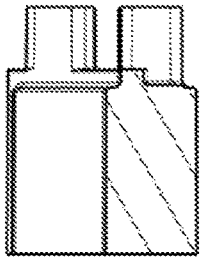
FIG. 10H is a cross-sectional view of the curved four-head building block shown in FIG. 10E, taken along line V-V.

Still referring to FIGS. 10A to 10I, there is shown that upper surface 618 defines an upper surface first longitudinal edge 644, an upper surface second longitudinal edge 646, which is distant from upper surface first longitudinal edge 644. Upper surface 618 further defines an upper surface third longitudinal edge 645, an upper surface fourth longitudinal edge 647, which is distant from upper surface third longitudinal edge 645. As best shown in FIG. 10E, second wall section upper longitudinal edges 640*a*, 640*b*, 640*d*, 640*e* respectively correspond to upper surface first, third, fourth and second longitudinal edges 644, 645, 647, 646, respectively. Moreover, there is shown that first wall section upper longitudinal edges 642*a*, 642*b*, 642*d*, 642*e* are parallel to and distant from upper surface first, third, fourth and second longitudinal edges 644, 645, 647, 646, respectively.

Still referring to FIGS. 10A to 10I, there is shown that lower surface 616 defines a lower surface first longitudinal edge 648 and a lower surface second longitudinal edge 650, which is distant from lower surface first longitudinal edge 648. Lower surface 616 further defines a lower surface third longitudinal edge 649 and a lower surface fourth longitudinal edge 651, which is distant from lower surface third longitudinal edge 649. Additionally, each one of the first wall sections 622*a*, 622*b*, 622*d*, 622*e* defines a first wall section lower edge 652*a*, 652*b*, 652*d*, 652*e* and each one of second wall sections 626*a*, 626*b*, 626*d*, 626*e* defines a second wall section lower longitudinal edge 654*a*, 654*b*, 654*d*, 654*e*. Both first wall section lower edges 652*a*, 652*b*, 652*d*, 652*e* and second wall section lower longitudinal edges 654*a*, 654*b*, 654*d*, 654*e* correspond to respectively lower surface first, third, fourth and second longitudinal edges 648, 649, 651, 650.

Each one of the first wall sections 622*a*, 622*b*, 622*d*, 622*e* further defines a first wall section side edge 656*a*, 656*b*, 656*c*, 656*d*, 656*e*, 656*f*. Similarly, each one of the second wall sections 626*a*, 626*b*, 626*d*, 626*e* further defines a second wall section side edge 660*a*, 660*b*, 660*c*, 660*d*, 660*e*, 660*f*. Therefore, according to the four-head building block 610 shown in FIGS. 10A to 10I, first wall section side edge 656*a* is at a distance from second wall section side edge 660*a* (wall 620*a*) and similarly, first wall section side edge 656*c* is at a distance from second wall section side edge 660*c* (wall 620*b*). Additionally, first wall section side edge 656*d* is at a distance from second wall section side edge 660*d* (wall 620*d*) and similarly, first wall section side edge 656*f* is at a distance from second wall section side edge 360*f* (wall 620*e*) (FIG. 10E). Therefore, similarly to blocks 110 shown in FIG. 5A, vertically oriented longitudinal groove 35 is formed between second wall section side edges of two adjacent building blocks, and at least part of first wall surfaces 624*a*, 624*b*, 624*d*, 624*e* (of such adjacent blocks), again, when building blocks 610 are fully connected one adjacent another.

Referring now more particularly to FIG. 10E, there is shown that each one of the spaced apart projections 630*a*, 630*b*, 630*c*, 630*d* comprises a projection upper surface 666, defining a substantially squared surface, and projection walls 668*a*, 668*b*, 668*c*, 668*d*, joining projection upper surface 666 and upper surface 618 of hollow main body 614. For each one of the spaced apart projections, or heads, 630*a*, 630*b*, 630*c*, 630*d* two of the four projection walls, namely projection walls 668*a*, 668*c* (for projections 630*a*, 630*b*) or projection walls 668*b*, 668*c* (for projection 630*c*) or projection walls 668*b*, 668*d* (for projection 630*d*), extend from upper surface 618 respectively at the upper surface first and second longitudinal edges 644, 648 (for projections 630*a*, 630*b*), at the upper surface third and fourth longitudinal edges 645, 649 (for projection 630*d*) or at the upper surface second and fourth longitudinal edges 648, 649 (for projection 630*c*). Therefore, as shown, for projections 630*a*, 630*b*, projection walls 668*a* share the same plan with first wall surface 624*a* of wall 620*a*, while projection walls 668*c* share the same plan with first wall surface 624*e* of wall 620*e*. For projection 630*c*, projection wall 668*b* share the same plan with first wall surface 624*d* of wall 620*d*, while projection wall 668*c* share the same plan with first wall surface 624*e* of wall 620*e*. For projection 630*d*, projection wall 668*b* share the same plan with first wall surface 624*d* of wall 620*d*, while projection wall 668*d* share the same plan with first wall surface 624*b* of wall 620*b*.

Figure 10I:
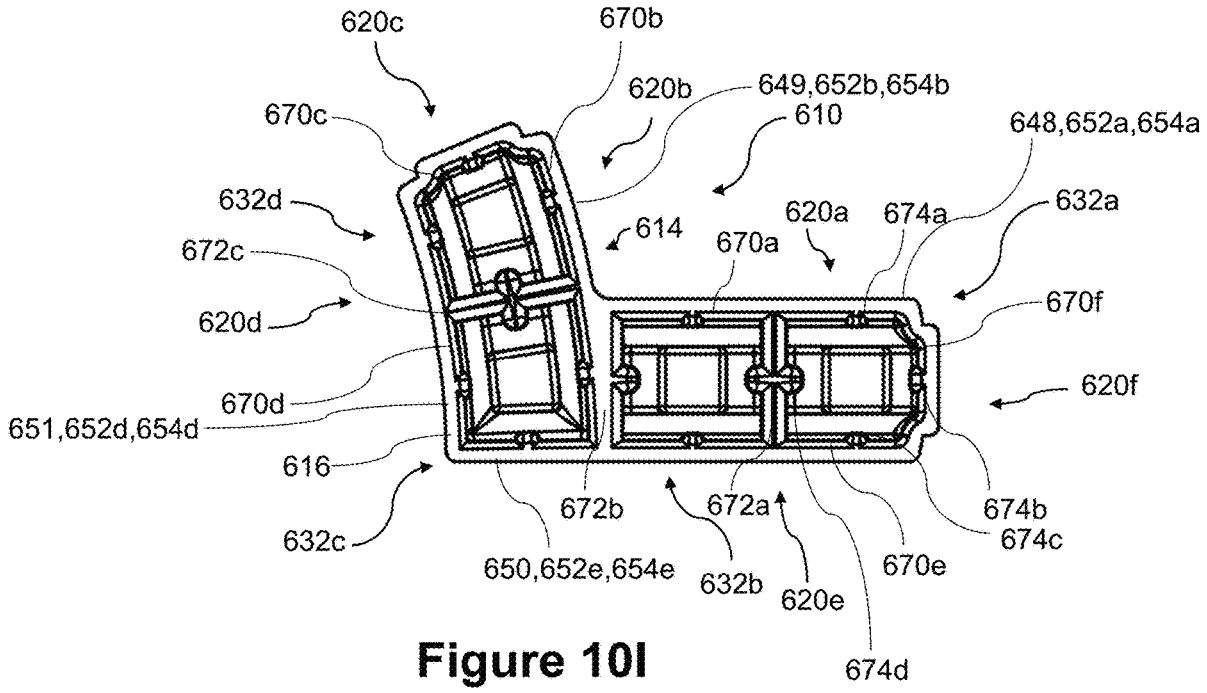
FIG. 10I is a bottom plan view of the curved four-head building block shown in FIGS. 10A-10B.

Referring now more particularly to FIG. 10I, there is shown that hollow main body 614 defines wall inner surfaces 670*a*, 670*b*, 670*c*, 670*d*, 670*e*, 670*f*. Building block 610 also further comprises inner walls 672*a*, 672*b*, 672*c* within hollow main body 614. Inner walls 672*a*, 672*b*, 672*c* extend from lower surface 616 towards upper surface 618 and join together walls 620*a*, 620*b*, 620*d*, 620*e*. Inner walls 672*a*, 672*b*, 672*c*, together with walls 620*a*, 620*b*, 620*c*, 620*d*, 620*e*, 620*f* form the spaced apart recess sections 632*a*, 632*b*, 632*c*, 632*d*.

Building block 610, as defined above, further comprises inner longitudinal protrusions (four inner longitudinal protrusions 674*a*, 674*b*, 674*c*, 674*d* for each one of the recess sections 632*a*, 632*b*, 632*c*, 632*d*). Each one of the inner longitudinal protrusions 674*a*, 674*b*, 674*c*, 674*d* longitudinally extends from lower surface 616 towards upper surface 618. Some of the inner longitudinal protrusions extend outwardly from wall inner surfaces 670*a*, 670*b*, 670*c*, 670*d*, 670*e*, 670*f*, while the remaining ones extend outwardly from inner walls 672*a*, 672*b*, 672*c* (or from both surfaces of inner walls). Each one of the inner longitudinal protrusions 674*a*, 674*b*, 674*c*, 674*d* is adapted to interface with a corresponding one of projection walls 668*a*, 668*b*, 668*c*, 668*d* when a lower building block 610 is fully connected to an upper building block 610 or to any other similar block (and where one or more of the spaced apart projection(s) is in alignment with a corresponding one of the one or more spaced apart recess sections).

Figure 11:
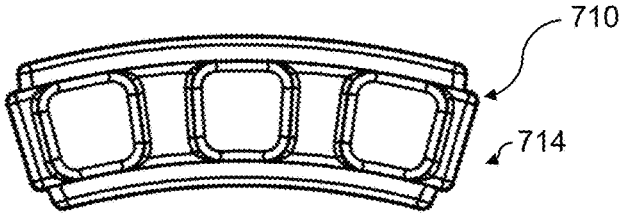
FIG. 11 is a top plan view of a curved three-head building block in accordance with yet another embodiment.
Figure 12:
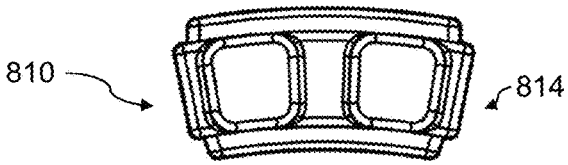
FIG. 12 is a top plan view of a curved two-head building block in accordance with another embodiment.
Figure 13:
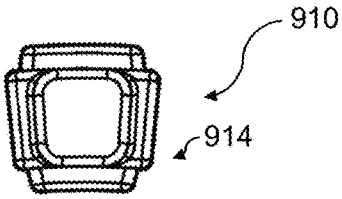
FIG. 13 is a top plan view of a curved one-head building block in accordance with a further embodiment.
Figure 14:
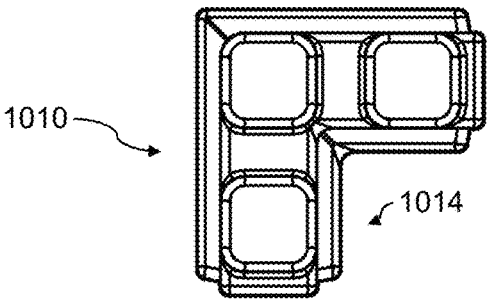
FIG. 14 is a top plan view of a corner three-head building block in accordance with yet another embodiment.
Figure 15A:
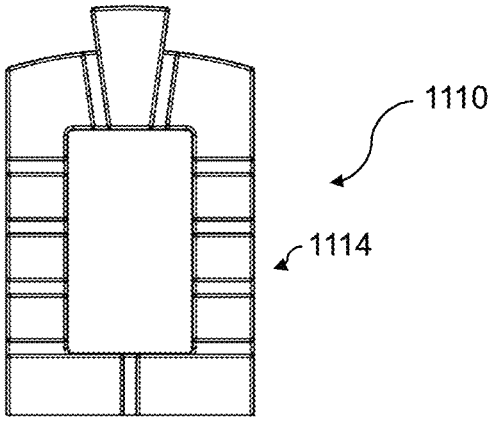
FIG. 15A is a front elevation view of a window building block in accordance with another embodiment.
Figure 15B:
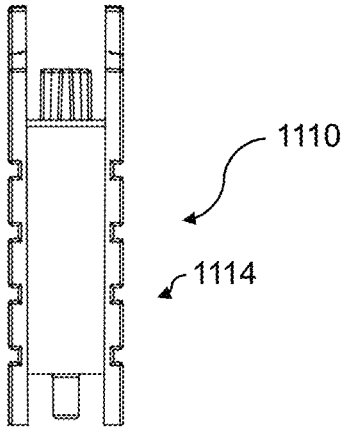
FIG. 15B is a side elevation view of the window building block of FIG. 15A.
Figure 15C:
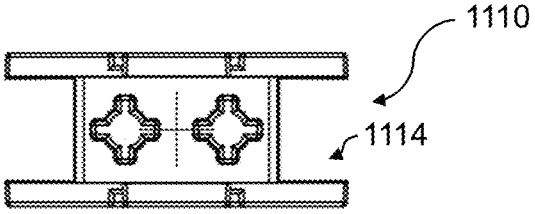
FIG. 15C is a top plan view of the window building block of FIG. 15A.
Figure 15D:
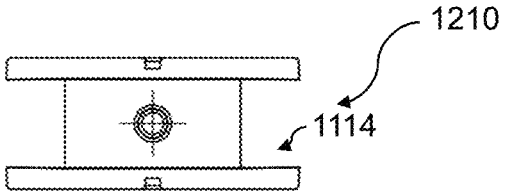
FIG. 15D is a bottom plan view of the window building block of FIG. 15A.
Figure 16A:
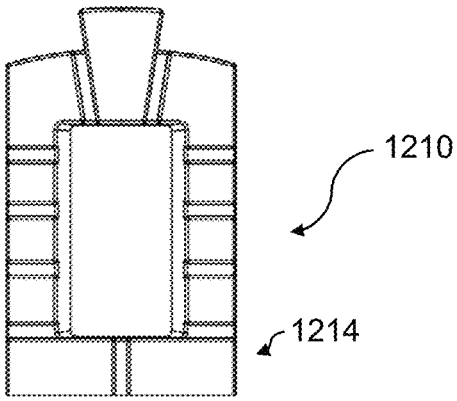
FIG. 16A is a front elevation view of a curved window building block in accordance with a further embodiment.
Figure 16B:
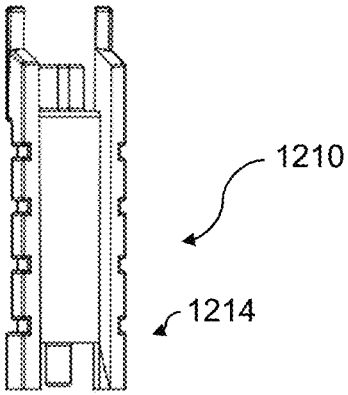
FIG. 16B is a side elevation view of the curved window building block of FIG. 16A.
Figure 16C:
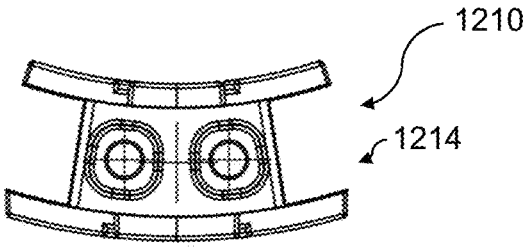
FIG. 16C is a top plan view of the curved window building block of FIG. 16A.
Figure 16D:
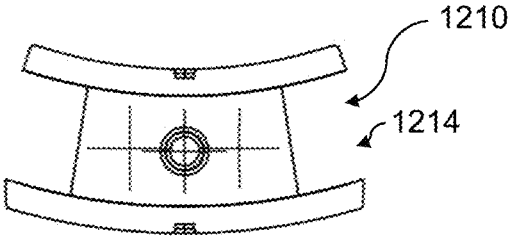
FIG. 16D is a bottom plan view of the curved window building block of FIG. 16A.

It is to be mentioned that a person skilled in the art to which the building blocks as defined above pertain would understand that hollow main body may take any shape, size and/or configuration, as long as its configuration allows adjacent building blocks of the same, or alternatively of a different, configuration, to provide horizontally and vertically oriented longitudinal grooves 34, 35 (as defined above), when the adjacent blocks are fully connected one to another. Indeed, as for example, FIG. 11 illustrates a curved three-head building block 710 which defines an elongated curved hollow main body 714, FIG. 12 illustrates a curved two-head building block 810 which defines an elongated curved hollow main body 814, FIG. 13 illustrates a curved single-head building block 910 which defines a curved hollow main body 914, while FIG. 14 illustrates a corner three-head building block 1010 which defines hollow main body 1014. Additionally, even if described blocks are shown to be provided with only one row of spaced apart projections, multiple rows of spaced apart projections may be provided (with multiple rows of spaced apart recess sections), as well as other configurations of spaced apart projections. Projections may also be provided with a different number of walls as well as with different configurations, sizes and/or shapes of projection upper surfaces, as long as the projections are capable of releasable connections with the spaced apart recess sections (that need to be configured accordingly).

The building blocks as defined above may be integrally formed and further made of a plastic material so that elastic deformation of the spaced apart projections and/or the inner longitudinal protrusions found in the spaced apart recess sections may occur when two or more building blocks are joined and connected together. Elastic deformation will cause a projection and a recess section to snap into mutual engagement.

FIGS. 15A to 15D illustrate a window building block 1110, defining a hollow main body 1114, that can be connected to the building blocks defined above (the ones that define a straight hollow main body).

Figure 17:
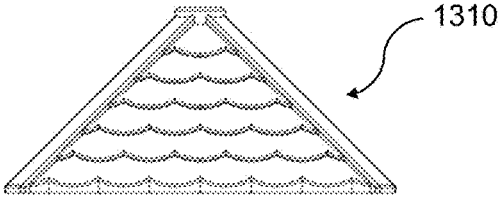
FIG. 17 is a front elevation view of a roof building block in accordance with yet another embodiment.
Figure 18:
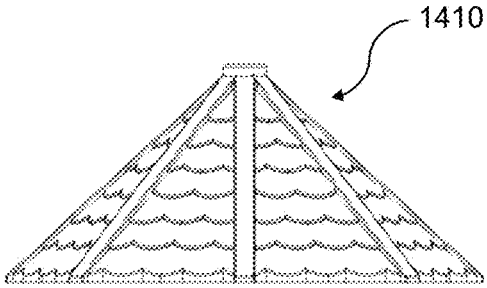
FIG. 18 is a front elevation view of a roof building block in accordance with another embodiment.
Figure 19:
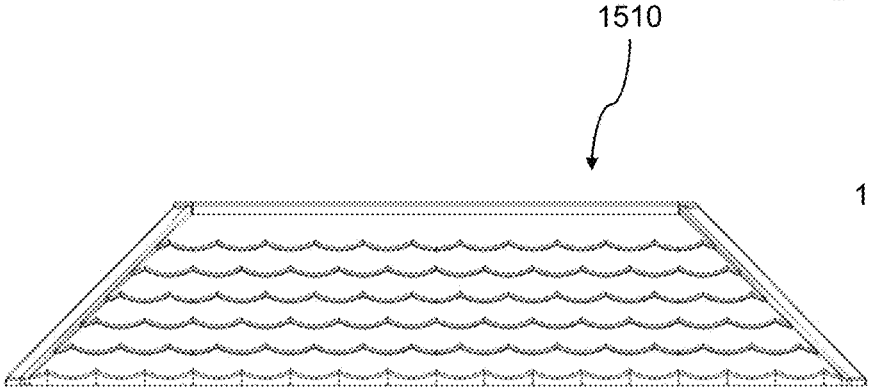
FIG. 19 is a front elevation view of a roof building block in accordance with a further embodiment.
Figure 20:
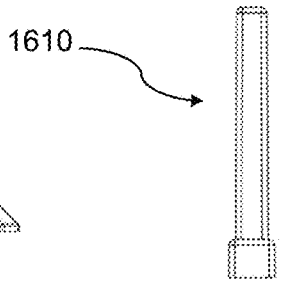
FIG. 20 is a front elevation view of a post building block in accordance with yet another embodiment.
Figure 21:
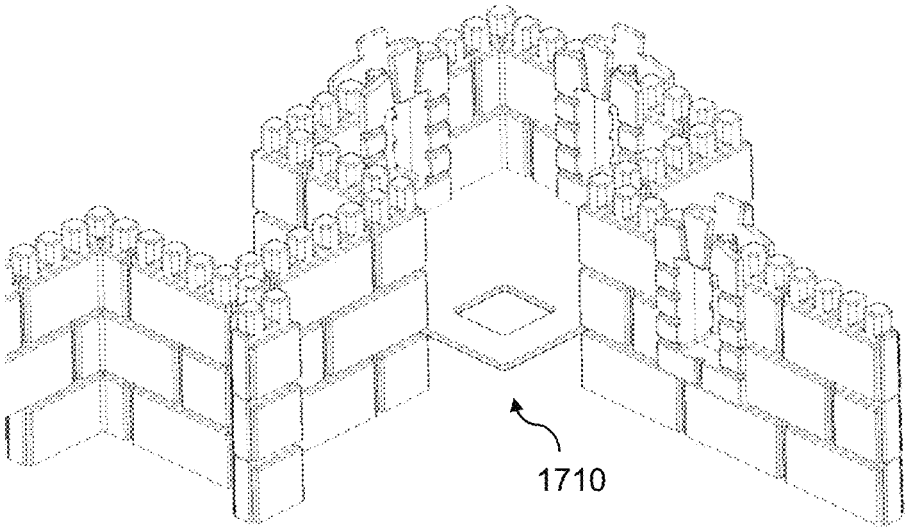
FIG. 21 is a perspective view of a toy building, or structure, in accordance with another embodiment, showing a flooring building block interfacing with the longitudinal groove defined by some of the building blocks.

Similarly, FIGS. 16A to 16D illustrate a curved window building block 1210, defining a hollow main body 1214, that can be connected to the building blocks defined above (the ones that define a curved hollow main body). As both window building blocks 1110, 1210 comprise projections and corresponding recess sections (similar to the ones described above for the conventional building blocks), they can be connected to any one of blocks 10, 110, 210, 310, 410, 510, 610, 710, 810, 910, 1010, or any other similar building block. Other components may be introduced with building set such as, without limitation, roofing building blocks 1310, 1410, 1510 shown in FIGS. 17-19 and posts, such as post building block 1610, shown in FIG. 20. FIG. 21 further illustrates part of a toy building, or structure, in which a flooring building block 1710 interfaces with horizontally oriented longitudinal grooves 34, and therefore, with some of the building blocks.

As well described, configuration of each one of the building blocks provides a useful alternative to known building blocks as horizontally oriented longitudinal grooves 34 and vertically oriented longitudinal grooves 35 are provided inbeetween the plurality of fully connected building blocks. Such horizontally and vertically oriented longitudinal grooves 34, 35 therefore provide the toy building 12 with a special appearance, as bricks (with brick sealant) look to be connected one adjacent another. Furthermore, it is to be mentioned that a plurality of components, such as the window building blocks, the roof building blocks, the post building blocks, the door building blocks and the like (lighting building blocks, etc.) may interface with both the horizontally aligned and vertically aligned longitudinal grooves. Therefore, as best shown in FIG. 21, the edges (the four edges) of a flooring building block 1710 interface with the horizontally oriented longitudinal grooves defined within four building walls made from the plurality of building blocks as defined above. Even if flooring building block 1710 is shown to interface with the longitudinal grooves found on four perpendicularly oriented walls, a person skilled in the art to which such blocks pertain would understand that, thanks to the configuration of the building blocks that provide the vertically and horizontally oriented longitudinal grooves 34, 35, only one wall, but preferably more than one walls, would be sufficient to strongly hold in place flooring building block 1710 or similar building block components.

Additionally, it is to be mentioned that even if in some of the building blocks defined above, spaced apart receiving grooves are provided inbetween the spaced apart projections to receive and connect/interface with additional building block components, it is not a requirement to find such receiving grooves on the building block. Building components may connect with the toy building or construction, even if receiving grooves are not provided. However, in a scenario where a building block include such receiving grooves positioned inbetween the spaced apart projections or heads, holes/recesses may be provided in the receiving grooves (in a direction toward the lower surface), so that they can receive pin-like members extending from the additional building block components. Thus, a flooring component may for example include a plurality of pin-like members that extend from its main body and the pin-like members may be configured so they can releasably connect with the holes/recesses provided within the receiving grooves. A strong but releasable connection may therefore be provided between the toy building (the building blocks) and the other components (lights, ropes, floors, windows, ladders and the like). In the case where the building blocks do not include such receiving grooves, the holes/recesses may be provided directly on the upper surface.

While preferred embodiments have been described above and illustrated in the accompanying drawings, it will be evident to those skilled in the art that modifications may be made therein without departing from the essence of this disclosure. Such modifications are considered as possible variants comprised in the scope of the disclosure.

The invention claimed is:

1. A corner building block for a toy building set, the corner building block being releasably joinable to another building block and comprising:

a hollow main body comprising:

a lower surface for supporting the hollow main body;

an upper surface opposite to the lower surface, the upper surface comprising at least an upper surface first side and an upper surface second side adjacent to the upper surface first side;

a plurality of walls connected to the lower surface and the upper surface and comprising at least a first wall connected to the upper surface first side; and a second wall connected to the upper surface second side, the plurality of walls each comprising a wall inner surface, at least the first and second walls comprising:

a first wall section comprising a first wall surface and a first wall section upper edge closed to the upper surface;

a second wall section comprising a second wall surface and a second wall section upper edge connected to the upper surface, the first wall section protruding from the second wall section;

wherein the second wall section is connected to the first wall section, the upper surface, and the lower surface;

wherein the second wall surface is parallel to and distant from the first wall surface;

spaced apart projections extending from the upper surface of the hollow main body in a direction opposite to the lower surface;

spaced apart recess sections disposed within the hollow main body about the lower surface and each being configured to enclose a corresponding spaced apart projection of a corresponding building block;

a longitudinal groove provided between the upper surface first side, the upper surface second side and the first wall section upper edges of the first and second walls, the upper surface first side and the upper surface second side being connected to the second wall sections of the first and second walls;

at least one inner wall within the hollow main body, and extending from the lower surface towards the upper surface, the at least one inner wall being connected to two of the wall inner surfaces of two of the plurality of walls at a right angle, wherein the at least one inner wall and the plurality of inner wall surfaces form the spaced apart recess sections; and at least one inner longitudinal protrusion protruding from the at least one inner wall and extending from the lower surface towards the upper surface.

2. The corner building block of claim 1, wherein a surface area of the first wall surface is greater than a surface area of the second wall surface.

3. The corner building block of claim 1, wherein the longitudinal groove is formed between the second wall section upper edges and the first wall section upper edges of the first and second walls.

4. The corner building block of claim 3, wherein the upper surface second side extends at an angle from the upper surface first side.

5. The corner building block of claim 4, wherein the first wall section upper edge of the first wall is parallel to and distant from the upper surface first side, and wherein the first wall section upper edge of the second wall is parallel to and distant from the upper surface second side.

6. The corner building block of claim 1, wherein the lower surface comprises at least a lower surface first side and a lower surface adjacent to the lower surface first side, the lower surface second side extending at an angle from the lower surface first side.

7. The corner building block of claim 1, wherein the first wall section further comprises:

a first wall section first side edge; and a first wall section second side edge opposite to the first wall section first side edge, and wherein the second wall section further comprises:

a second wall section first side edge; and a second wall section second side edge opposite to the second wall section first side edge;

wherein one of the first wall section first side edge or the first wall section second side edge of the first wall is connected to one of the first wall section first side edge or the first wall section second side edge of the second wall.

8. The corner building block of claim 7, wherein the other one of the first wall section first side edge or the first wall section second side edge of the first wall is disposed at a distance from the adjacent one of the second wall section first side edge or the second wall section second side edge of the first wall, and wherein the other one of the first wall section first side edge or the first wall section second side edge of the second wall is disposed at a distance from the adjacent one of the second wall section first side edge or the second wall section second side edge of the second wall.

9. The corner building block of claim 1, wherein the hollow main body further comprises at least one receiving groove between at least two adjacent ones of the spaced apart projections.

10. The corner building block of claim 1, wherein each one of the spaced apart projections comprises:

a projection upper surface; and projection walls connected to the projection upper surface and the upper surface of the hollow main body.

11. The corner building block of claim 10, wherein the projection upper surface has a substantially squared surface, and each one of the spaced apart projections comprises four projection walls connected to the projection upper surface and the upper surface of the hollow main body.

12. The corner building block of claim 11, wherein one of the four projection the upper surface respectively at the upper surface at least one of the spaced apart projections has a first projection wall extending upwardly from the upper surface at the upper surface first side.

13. The corner building block of claim 12, wherein the at least one of the spaced apart projections has a second projection wall, adjacent to the first projection wall, extending upwardly from the upper surface at the upper surface second side.

14. The corner building block of claim 1, wherein a cross-sectional surface area of the hollow main body is at least one of: an incurved shape, an L-like shape, a T-like shape, an incurved L-like shape, and an incurved T-like shape.

15. The corner building block of claim 1, wherein the upper surface of the hollow main body further comprises an upper surface third side and an upper surface fourth side adjacent to the upper surface third side, and wherein the plurality of walls further comprise a third wall connected to the upper surface third side and a fourth wall connected to the upper surface fourth side, and further wherein another longitudinal groove is provided between the upper surface third side, the upper surface fourth side and the first wall section upper edges of the third and fourth walls.

16. The corner building block of claim 15, wherein the upper surface third side and the upper surface fourth side are connected to the second wall section upper edges of the third and fourth walls.

17. The corner building block of claim 15, wherein one of the first wall section first side edge or the first wall section second side edge of the third wall is connected to one of the first wall section first side edge or the first wall section second side edge of the fourth wall.

18. The corner building block of claim 16, wherein the other one of the first wall section first side edge or the first wall section second side edge of the third wall is disposed at a distance from the adjacent one of the second wall section first side edge or the second wall section second side edge of the third wall, and wherein the other one of the first wall section first side edge or the first wall section second side edge of the fourth wall is disposed at a distance from the adjacent one of the second wall section first side edge or the second wall section second side edge of the fourth wall.

19. The corner building block of claim 1, wherein the first wall is parallel to the third wall, and the second wall is parallel to the fourth wall.

20. The corner building block of claim 1, comprising at least six walls.

* * * * *